US005774766A

United States Patent [19]

Karakama et al.

[11] Patent Number: 5,774,766

[45] Date of Patent: Jun. 30, 1998

[54] PROCESS CARTRIDGE, PROCESS CARTRIDGE ASSEMBLY METHOD, AND ELECTROPHOTOGRAPHIC IMAGE FORMING APPARATUS

[75] Inventors: Toshiyuki Karakama, Tokyo; Isao Ikemoto, Kawasaki; Yoshikazu Sasago, Tokyo; Haruhisa Oshida, Hatogaya; Shinya Noda, Yokohama, all of Japan

[73] Assignee: Canon Kabushiki Kaisha, Tokyo, Japan

[21] Appl. No.: 671,845

[22] Filed: Jun. 28, 1996

[30] Foreign Application Priority Data

Jun. 30, 1995 [JP] Japan ..... 7-165352

[51] Int. Cl.[6] ..... G03G 12/16

[52] U.S. Cl. ..... 399/111; 399/119

[58] Field of Search ..... 399/111, 119, 399/98, 102, 103, 106, 107

[56] References Cited

U.S. PATENT DOCUMENTS 4,931,838 6/1990 Ban et al. ..... 399/106
5,475,467 12/1995 Watanabe et al. ..... 399/111
5,543,898 8/1996 Shishido et al. .
5,550,617 8/1996 Odagawa et al. ..... 399/111 X
5,583,618 12/1996 Takeuchi et al. ..... 399/111
5,585,895 12/1996 Yashiro et al. ..... 399/103

*Primary Examiner*—Sandra L. Brase
*Attorney, Agent, or Firm*—Fitzpatrick. Cella, Harper & Scinto

[57] ABSTRACT

A process cartridge detachably mountable to a main assembly of an electrophotographic image forming apparatus comprises an electrophotographic photosensitive drum, a development roller for developing a latent image formed on the electrophotographic photosensitive drum, a toner accommodating portion for accommodating toner to be used by the development roller for development, a photosensitive drum frame for supporting the electrophotographic photosensitive drum, a development frame including the toner accommodating portion, and a support frame including a first toner leakage preventing member positioned at one longitudinal end of the development roller and a second toner leakage preventing member positioned at the other longitudinal end of the development roller. The development frame and the support frame are rotatably connected about a positioning member and, in this connected state, a portion of the development frame is welded to a portion of the support frame so that the development frame and the support frame are joined together.

45 Claims, 19 Drawing Sheets

PROCESS CARTRIDGE, PROCESS CARTRIDGE ASSEMBLY METHOD, AND ELECTROPHOTOGRAPHIC IMAGE FORMING APPARATUS

FIELD OF THE INVENTION AND RELATED ART

The present invention relates to a process cartridge, a method for assembling a process cartridge, and an electrophotographic image forming apparatus.

A process cartridge system in which the process cartridge is removably installed in the main assembly of an image forming apparatus, has been employed in an image forming apparatus based on the electro-photographic image formation process. According to this process cartridge system, users themselves can maintain the image forming apparatus; there is no need for service personnel. Therefore, this process cartridge system can remarkably improve the operational efficiency of the image forming apparatus. Consequently, the process cartridge system has been widely employed in the field of the image forming apparatus.

The conventional process cartridge has been fabricated by dividing the cartridge into a plurality of frames and joining the frames together by way of injection molding of synthetic resin, assembly of parts and other steps. In such process cartridge manufacture steps, the frames may be joined together with the ultrasonic welding to not only prevent the toner from leaking through between the frames, but also ensure the joining to be positively made.

The ultrasonic welding is performed by applying ultrasonic vibrations to be concentrated onto a target portion while exerting pressure on the same portion, so that the target portion is heated and joined to the corresponding portion by welding. Therefore, the welded portion requires a rib onto which the vibrations are to be concentrated. Thus, since the position of the welded frame is determined while melting the weld rib, it may be often troublesome to position the welded frame with sufficient precision under some welding conditions.

For example, the positional relationships between a development roller and a development blade and between a development roller and a toner leakage preventing seal have to meet strict limitations from the standpoints of image forming, toner sealing, etc. One conceivable means to solve this problem is below. As shown in FIG. 19, a mounting seat 51 for the development blade and mounting seats 52 for the toner leakage preventing seals, which come in contact with the development roller near its both ends, are provided on a frame 50 having a toner accommodating portion. Then, development roller bearings 53 are attached to the frame 50. The members having to meet the strict demand for position accuracy are thus mounted on one frame so that the members are positioned relative to each other with sufficient precision.

The present invention is a result of the further development of the aforementioned process cartridge.

SUMMARY OF THE INVENTION

Accordingly, a primary object of the present invention is to provide a process cartridge which can be assembled with improved efficiency, a method for assembling the process cartridge with improved efficiency, and an electrophotographic image forming apparatus compatible with such a process cartridge.

Another object of the present invention is to provide a process cartridge in which a plurality of frames can be joined together with improved position accuracy, a method for assembling the process cartridge, and an electrophotographic image forming apparatus.

Still another object of the present invention is to provide a process cartridge in which a plurality of frames can be easily positioned when joined together, a method for assembling the process cartridge, and an electrophotographic image forming apparatus.

Still another object of the present invention is to provide a process cartridge in which a plurality of frames can be joined together by welding with improved position accuracy, and welding conditions of the frames can be easily controlled while increasing productivity, a method for assembling the process cartridge, and an electrophotographic image forming apparatus.

Still another object of the present invention is to provide a process cartridge in which a development frame and a support frame are rotatably connected about a positioning member and, in this connected state, a portion of the development frame and a portion of the support frame are welded to each other so that the development frame and the support frame are joined together, a method for assembling the process cartridge, and an electrophotographic image forming apparatus.

DESCRIPTION OF THE PREFERRED EMBODIMENTS

Hereinafter, the preferable embodiments of the present invention will be described in detail with reference to the drawings.

First, referring to FIGS. 1–18, a process cartridge in accordance with the present invention, and an electrophotographic image forming apparatus usable with such a process cartridge will be described in detail. As for the order in which descriptions are given, the general structures of the process cartridge and the image forming apparatus employing the process cartridge will be described at first, and then, the structure of cartridge frames will follow. Thereafter, the structure for joining a development frame and a support frame and the structure for joining a toner development frame and a cleaning frame will be described.

{General Structure}

Figure 4:
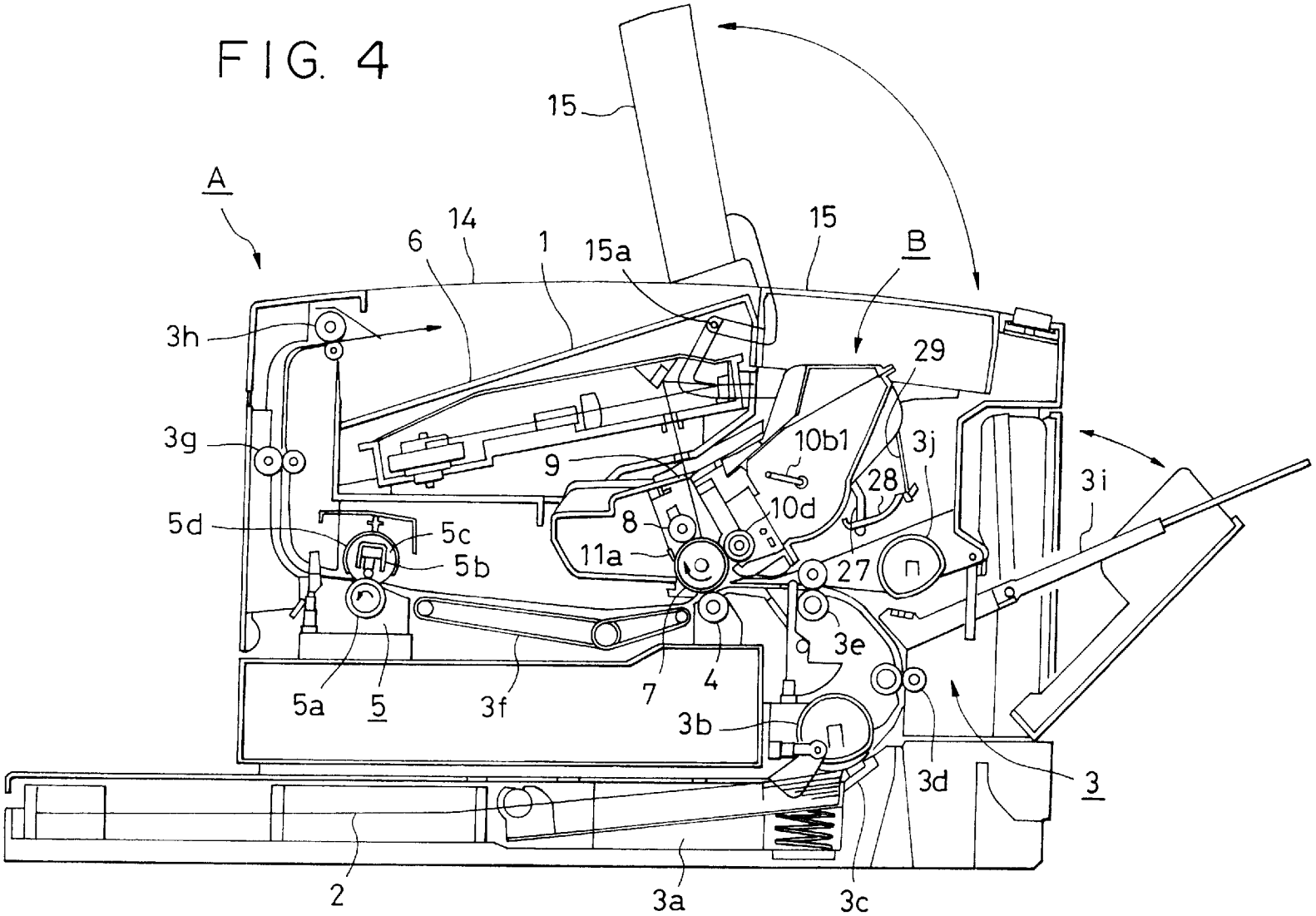
FIG. 4 is a schematic section of an electro-photographic image forming apparatus, depicting the general structure thereof.

Referring to FIG. 4, in the electro-photographic image forming apparatus A (laser beam printer) in accordance with the present invention, a light beam which carries image data is projected from an optical system 1 onto an electrophotographic photosensitive member in the form of a drum to form a latent image thereon, and this latent image is developed into a toner image. The electro-photographic photosensitive member is charged by a charge roller 8 before it is irradiated with the image data carrying light beam. In synchronism with the formation of the toner image, recording mediums 2 disposed in a sheet feeder cassette 3*a* are separated and fed into the electro-photographic image forming apparatus one by one by a pickup roller 3*b* and a pressing member 3*c* placed in contact with the pickup roller 3*b* to apply a predetermined pressure. The recording medium 2 is further conveyed into the apparatus by a conveying means 3 comprising a conveyer roller pair 3*d*, a registration roller pair 3*e*, and the like. As a voltage is applied to a transfer roller 4 as a transferring means, the toner image formed on the electro-photographic photosensitive member integrally disposed in a process cartridge B is transferred onto the recording medium 2. The recording medium 2 having received the toner image is delivered to a fixing means 5 by a conveyer belt 3*f*. The fixing means 5 comprises a driving roller 5*a*, and a fixing roller 5*d*. The fixing roller 5*d* contains a heater 5*b* and is rotatively supported by a supporting member 5*c*. While the recording medium 2 is passed through the fixing means 5, heat and pressure are applied to the recording medium 2, whereby the toner image having been transferred onto the recording medium is fixed to the recording medium 2. The recording medium 2 with the fixed toner image is conveyed through a reversing passage and discharged into a sheet catcher portion 6, by discharge roller pairs 3*g* and 3*h*. This image forming apparatus A also comprises a manual feeder tray 3*i* and a roller pair 3*j* so that the recording medium 2 can be manually fed.

Figure 5:
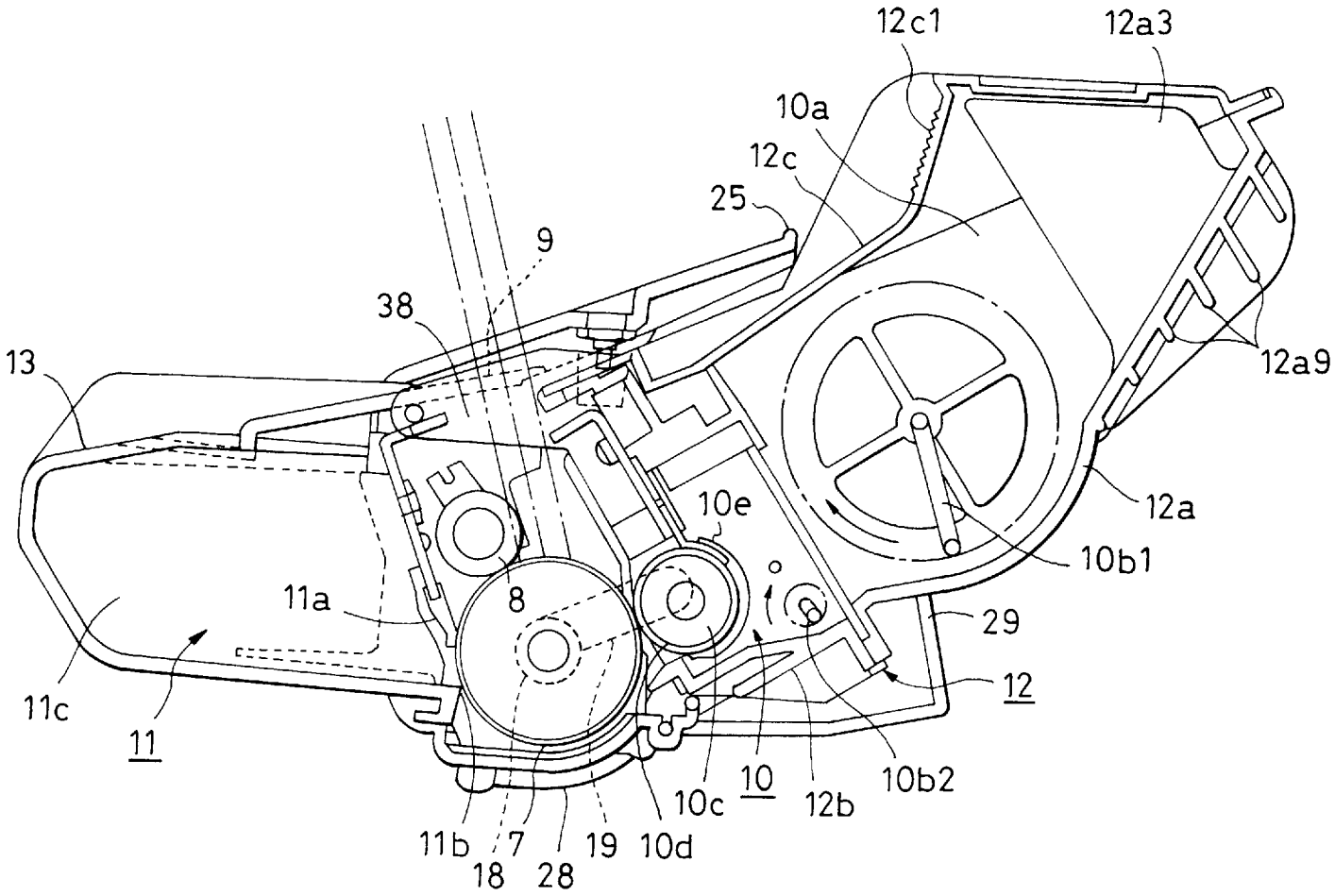
FIG. 5 is a cross-section of a process cartridge.

Referring to FIG. 5, in the process cartridge B, a photosensitive drum 7, which is a drum-shaped electrophotographic photosensitive member with a photosensitive layer, is rotated, and the surface of the rotating photosensitive drum 7 is uniformly charged by applying a voltage to the charge roller 8 which is the charging means. The surface of the photosensitive drum 7 is exposed to an optical image projected from the aforementioned optical system 1 through an opening 9, whereby a latent image is formed on the photosensitive drum 7. The latent image is developed by a developing means 10. As is evident from FIG. 5, the charge roller 8 is in contact with the photosensitive drum 7.

In the developing means 10, the toner contained in a toner holding portion 10*a* is sent out by a first rotary toner feeding member 10*b*1 and a second rotary toner feeding member 10*b*2, onto a development roller 10*d*, which is a developing member containing a fixed magnet 10*c*. As the development roller 10*d* is rotated, a layer of toner triboelectrically charged by the development blade 10*e* is formed on the surface of the development roller 10*d*. The toner particles in the toner layer are transferred onto the photosensitive drum 7 in correspondence to the aforementioned latent image, whereby the latent image is developed into a toner image, that is, a visible image.

After the toner image is transferred onto the recording medium 2 by applying to the transfer roller 4 a voltage with a polarity opposite to that of the toner image, the toner remaining on the photosensitive drum 7 is removed by a cleaning means 11 comprising a cleaning blade 11*a* for scraping off the residual toner, a reception sheet 11*b* for receiving the toner scraped from the photosensitive drum 7, and a waste toner collector 11c for collecting the waste toner. As is evident from FIG. 5, the cleaning blade 11*a* is in contact with the photosensitive drum 7.

The components such as the photosensitive drum 7 are integrally disposed within the frame of the process cartridge B, so that they can be removably installed within the apparatus main assembly 14. The cartridge frame is formed by joining a toner development frame 12 and a cleaning frame 13.

Figure 7:
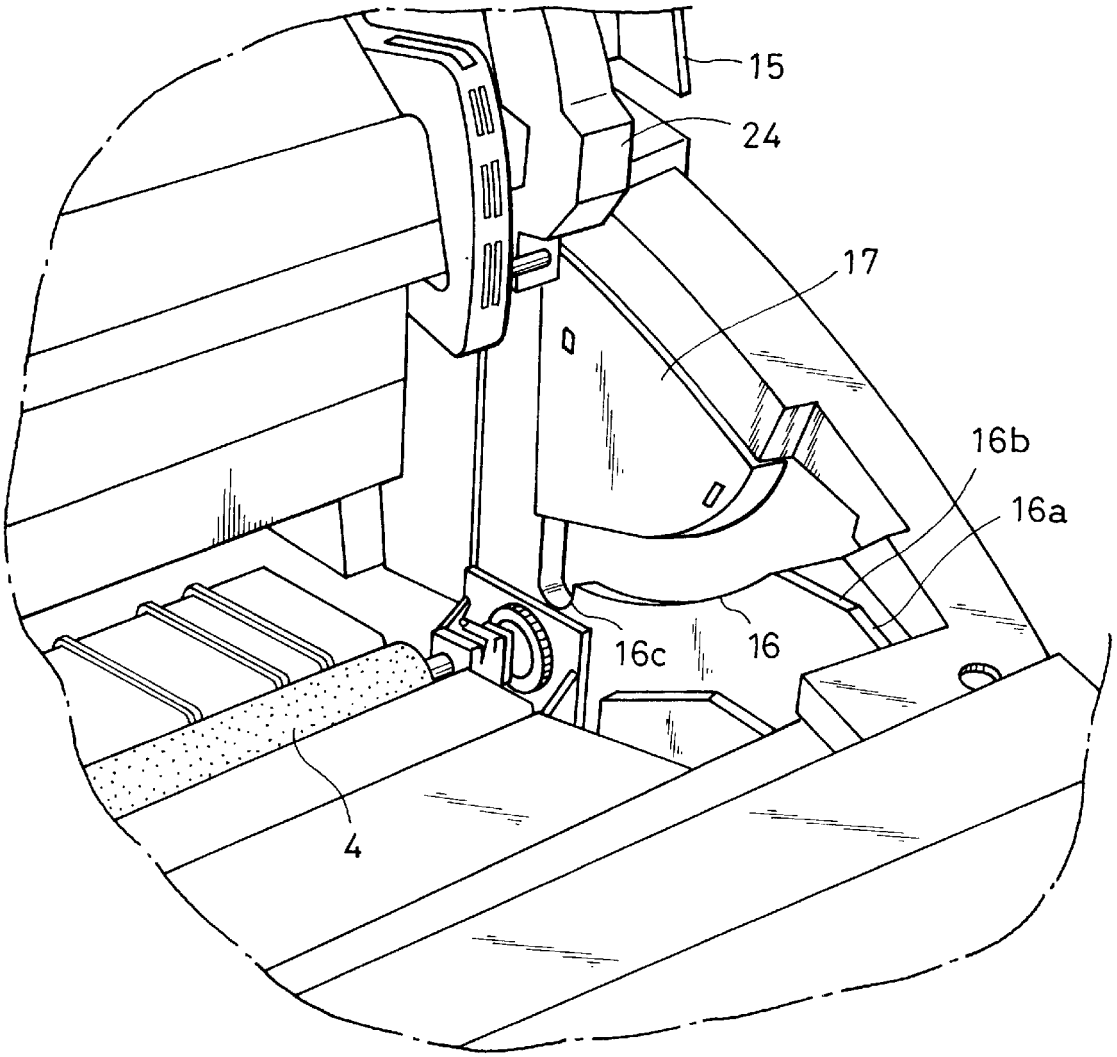
FIG. 7 is an explanatory drawing depicting the structure of the right-hand guide for guiding the process cartridge during the insertion or removal thereof.
Figure 8:
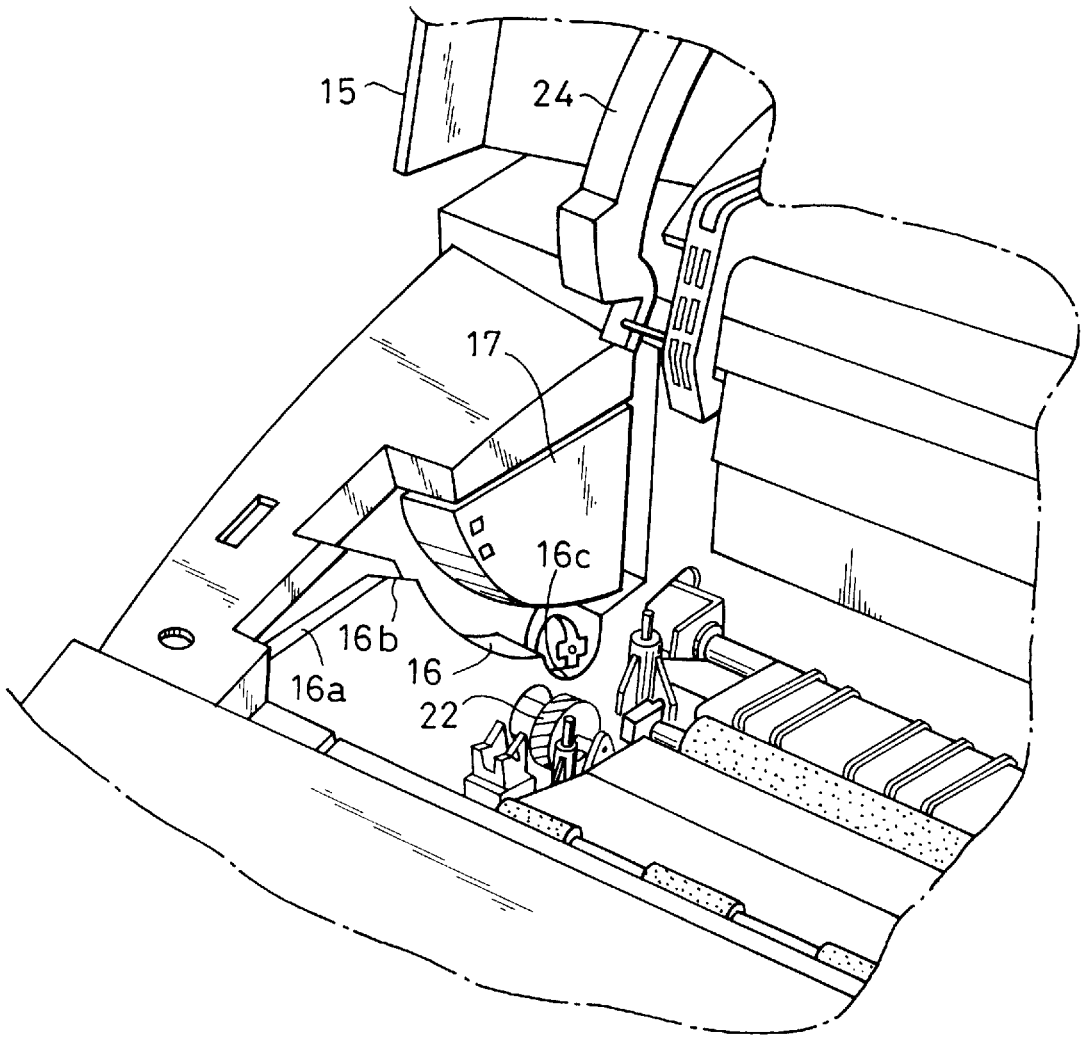
FIG. 8 is an explanatory drawing depicting the structure of the left-hand guide for guiding the process cartridge during the insertion or removal thereof.

The process cartridge B is installed in the apparatus main assembly 14 by opening the lid 15 as shown in the drawing. Referring to FIGS. 7 and 8, the cartridge installation means comprises a pair of guide rails 16, which are exposed as the lid 15 is rotatively opened about an axis 15*a* (FIG. 4). The guide rails 16 are given an upward bowing curvature (in this embodiment, substantially arc-shaped), and symmetrically located in the respective lateral walls of the apparatus main assembly 4 across the cartridge accommodating space. Above the guide rail 16, a guide member 17 is attached. On the entrance side of the guide rail 16, a first slant surface 16*a*, and a second slant surface 16*b* are provided. The second slant surface 16*b* has a steeper angle than the first slant surface 16*a*, and extends further downward from the bottom end of the first slanted surface 16*a*.

Figure 6:
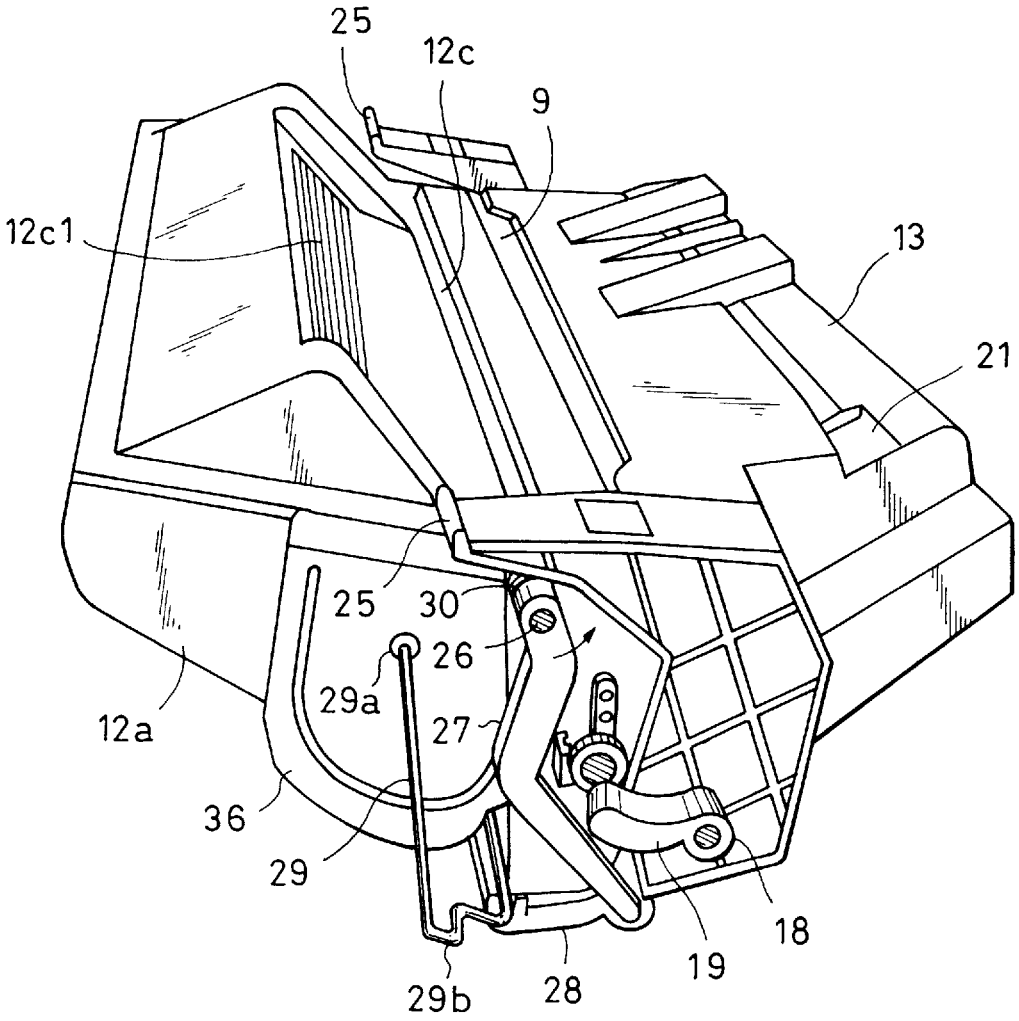
FIG. 6 is an external perspective view of the process cartridge.

On the other hand, the surfaces of the left and right longitudinal ends of the process cartridge B are provided with a guide portion, wherein the two guide portions symmetrically project in the longitudinal direction from the corresponding end surfaces of the process cartridge B, and are guided by the guide rail 16. Referring to FIG. 6, the guide portion integrally comprises a boss portion 18 and a rib portion 19. The boss portion 18 and the rib portion 19 are integrally formed with the cleaning frame 13 to which the photosensitive drum 7 is attached. The boss portion 18 is in line with the imaginary extension of the rotational axis of the photosensitive drum 7, and the rib portion 19 extends backward, relative to the inserting direction of the process cartridge B, from the boss portion 18, forming a upward bowing curvature (in this embodiment, substantially arc-shaped), which matches the configuration of the guide rail 16.

Referring to FIGS. 9–12, when the process cartridge B is installed into the apparatus main assembly with the above described structure, the lid 15 is first opened, and the process cartridge B is inserted into the apparatus main assembly so that the leading end of the process cartridge B is caused to dive into the space below the optical means 1. The guide rail 16 is arc-shaped, and the guide member 17 disposed above the guide rail 16 is given a configuration matching that of the guide member 17. Further, the rib 19 also is given a configuration similar to that of the guide member 17. Consequently, as the process cartridge B is inserted deeper, its orientation becomes substantially horizontal. As the cartridge B is pushed further inward, a bumping member 20 provided on the apparatus main assembly 14 comes in contact with a contact surface 21 provided on each longitudinal end of the leading end portion of the cleaning frame 13, and then, the boss portion 18 of the process cartridge drops into a recess 16*c* located at the deepest end of the guide rail 16. As a result, a drum gear (unillustrated) fixed to one of the longitudinal ends of the photosensitive drum 7 is caused to engage with the driving gear 22 (FIG. 8) provided on the apparatus main assembly 14 side, enabling the driving force to be transmitted to the process cartridge B.

Figure 11:
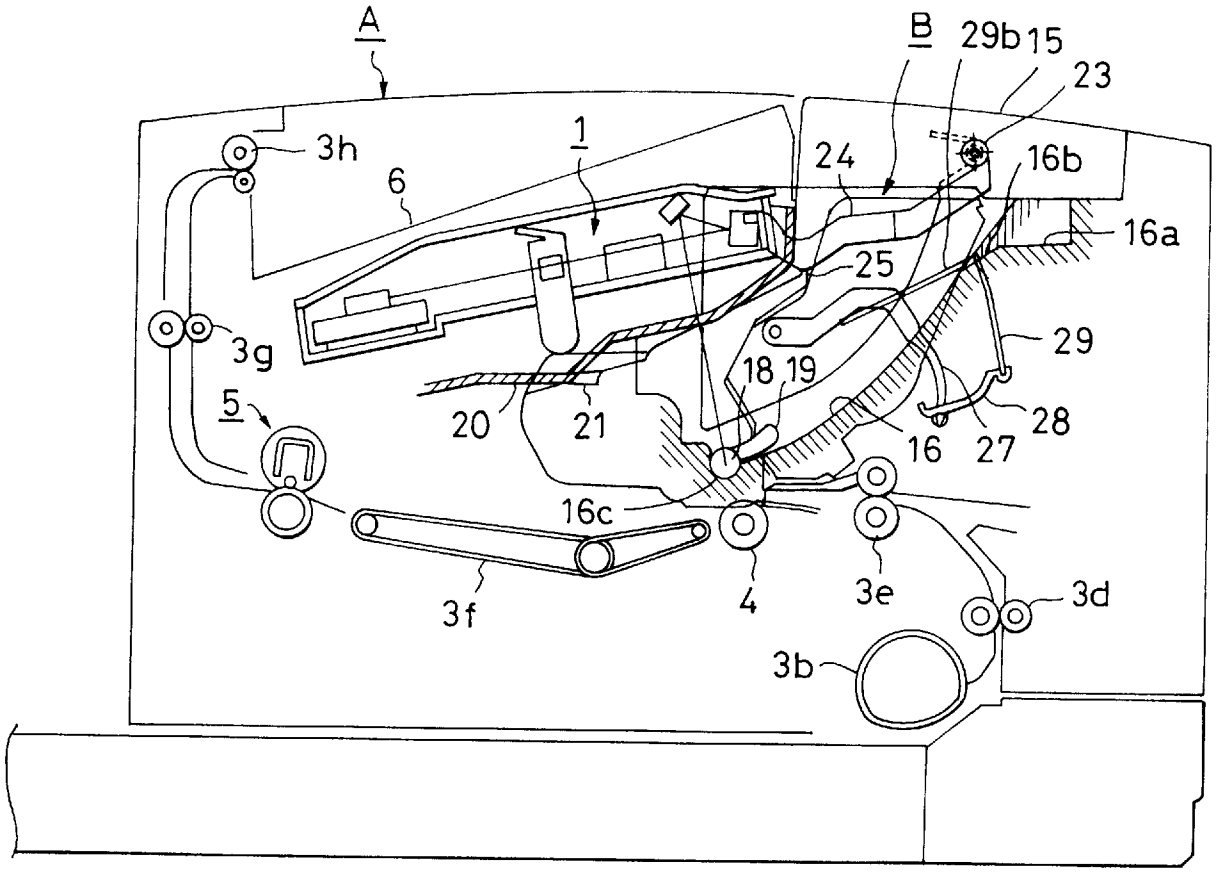
FIG. 11 is an explanatory drawing depicting the internal structure of the image forming apparatus in which the process cartridge has been incorporated.

Next, referring to FIG. 11, as the lid 15 is closed, a pressing member 24, which is axially supported on the lid 15, and is under the pressure from a torsional coil spring, makes contact with the arm portion 15 of the cleaning frame 13, pressing it with a predetermined pressure generated from the torsional coil spring being torqued by the closing movement of the lid 15. At the same time, the bumping member 20 provided on the apparatus main assembly 14 makes contact with the contact surface 21 of the process cartridge B, fixing the position of the process cartridge B.

Figure 12:
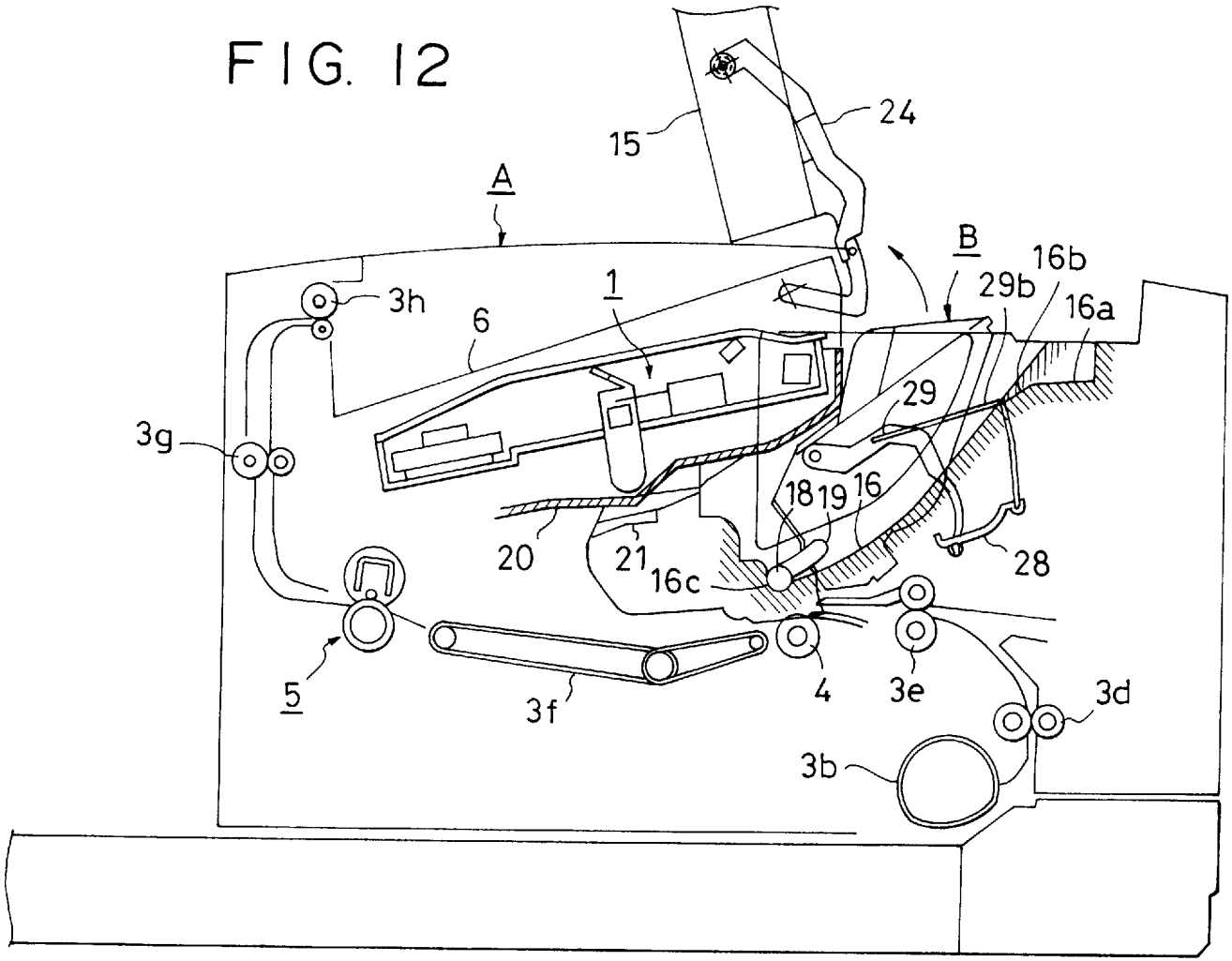
FIG. 12 is an explanatory drawing depicting the state of the process cartridge being taken out of the image forming apparatus.

Referring to FIG. 12, in order to take out the process cartridge B, the users open the lid 15, whereby the pressure applied through the pressing member 24 is removed. In this state, the cartridge B is pulled upward so that the boss portion 18 comes out of the recess 16*c*. Thereafter, the process cartridge B can be removed by pulling it as if rotating it in the counterclockwise direction of FIG. 12, with the rib portion 19 following the guide rail 16.

Figure 10:
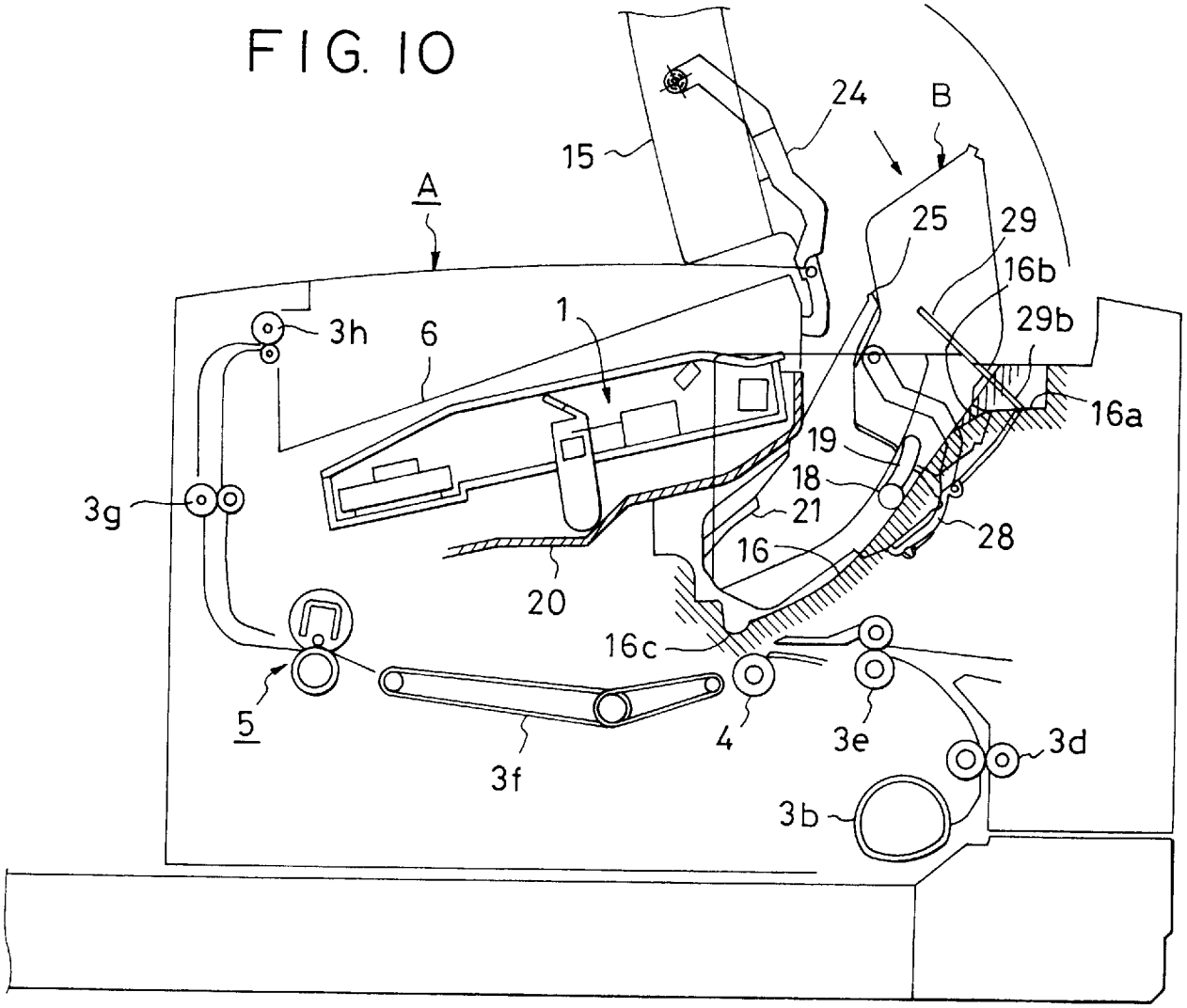
FIG. 10 is a sectional explanatory drawing depicting the state of the process cartridge having been partially inserted into the image forming apparatus.

The bottom portion of the cartridge frame is provided with an opening O, through which the photosensitive drum 7 comes in contact with the conveyed recording medium 2. When the cartridge is not in use, the opening is covered by closing a drum shutter member 28 to protect the photosensitive drum 7. Referring to FIG. 6, the drum shutter member 28 is rotatively supported by a shutter arm 27 and a link member 29. The shutter arm 27 is rotatively mounted on an axis 26 projecting outward from the longitudinal lateral wall of the development frame 12, but the link member 29 is supported on the longitudinal lateral wall of the cartridge frame so that it can be rotated about the rotational center 29*a*. As the process cartridge B is inserted along the guide rail 16 as described above, a projecting portion 29*b* constituted of the bend portion of the link member 29 comes in contact with the first and second slant surfaces 16*a* and 16*b* of the guide rail 16, causing the shutter member 28 to open (FIGS. 10 and 11). On the contrary, as the process cartridge B is taken out, the shutter member 28 is automatically closed by the pressure from the torsional coil spring 30 (FIG. 6) fitted around the axis 26.

Figure 9:
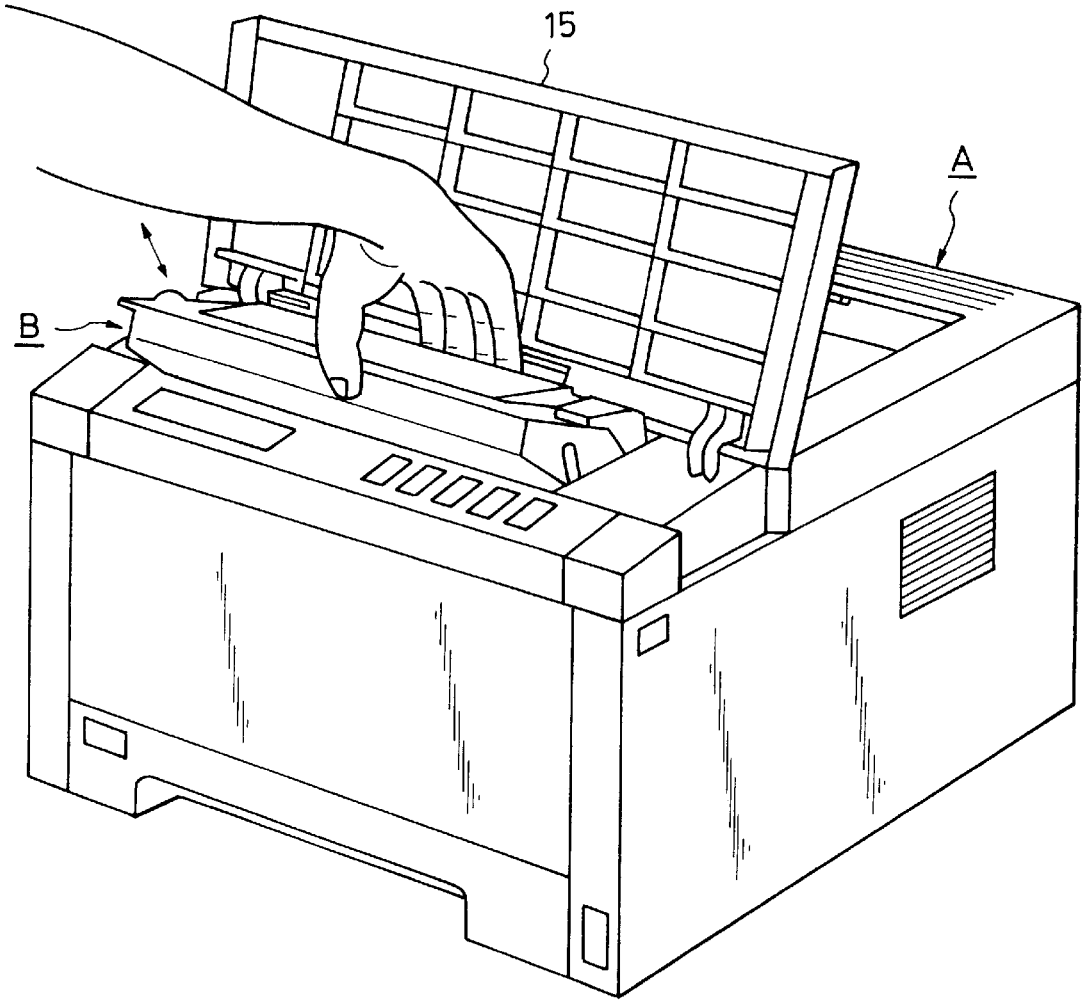
FIG. 9 is a perspective view depicting how the process cartridge is installed into the image forming apparatus.

When the process cartridge B is inserted into or removed from the image forming apparatus A, the users pick up process cartridge B by the handhold portion 12*c*2 of the development frame 12. The handhold portion 12*c*2 comprises the slanted upward facing surface of the cartridge lid 12*c*. Referring to FIG. 6, this slanted portion, that is, the handhold portion 12*c*2, is provided with minute ridges and valleys formed by numerous ribs 12*c*1 (extending in the direction perpendicular to the direction in which the process cartridge B is inserted into, or removed from, the apparatus main assembly). Referring to FIG. 5, the bottom portion of the cartridge frame is provided with an R portion which bulges downward, and this R portion is provided with several ribs 12*a*9 extending in the same direction as the aforementioned ribs 12*a*1, constituting the handhold portion 12*a*10. In order to install the process cartridge B into the image forming apparatus A, or remove it therefrom, the users pick up the process cartridge B by grasping it by the handhold portions 12*c*2 and 12*a*10 (ribs 12*c*1 and ribs 12*a*9) as illustrated in FIG. 9, and then insert it into the apparatus main assembly, with the boss portion 18 and the rib portion 19 of the cleaning frame 13 following the guide rail 16.

When the process cartridge B is pushed into the apparatus main assembly excessively fast, the process cartridge B is liable to be subjected to a large shock, which mostly acts on the pin 41 joining the development frame 12 and the cleaning frame 13. However, the development frame 12 and the cleaning frame 13 are rotatable about the pin 41; therefore, the aforementioned shock is distributed throughout the entire cartridge frame; the shock does not concentrate on a specific portion. In other words, the shock does not concentrate on the welded joint between the toner holding frame portion 12*a* and the development frame bottom portion 12*b*.

Therefore, the strength with which the toner holding frame portion 12*a* and the development frame bottom portion 12*b* are welded has only to be enough to keep both frame portions 12*a* and 12*b* joined. Consequently, when welding the toner holding frame portion 12*a* and the development frame bottom portion 12*b*, it is unnecessary to specifically control the welding conditions, allowing the development frame 12 to be assembled without losing productivity.

Further, the means for positioning the development roller 10*d*, and a mounting seat for the development blade 10*e*, are provided on the toner holding frame portion 12*a* as described in the foregoing. Therefore, in spite of the fact that the toner holding frame portion 12*a* is provided with the arm portion 38, the development roller 10*d* and the development blade 10*e* can be precisely positioned, so that their positional relationship with the photosensitive drum 7 mounted on the cleaning frame 13 can be maintained with sufficient precision.

{Structure of Cartridge Frame}

Figure 13:
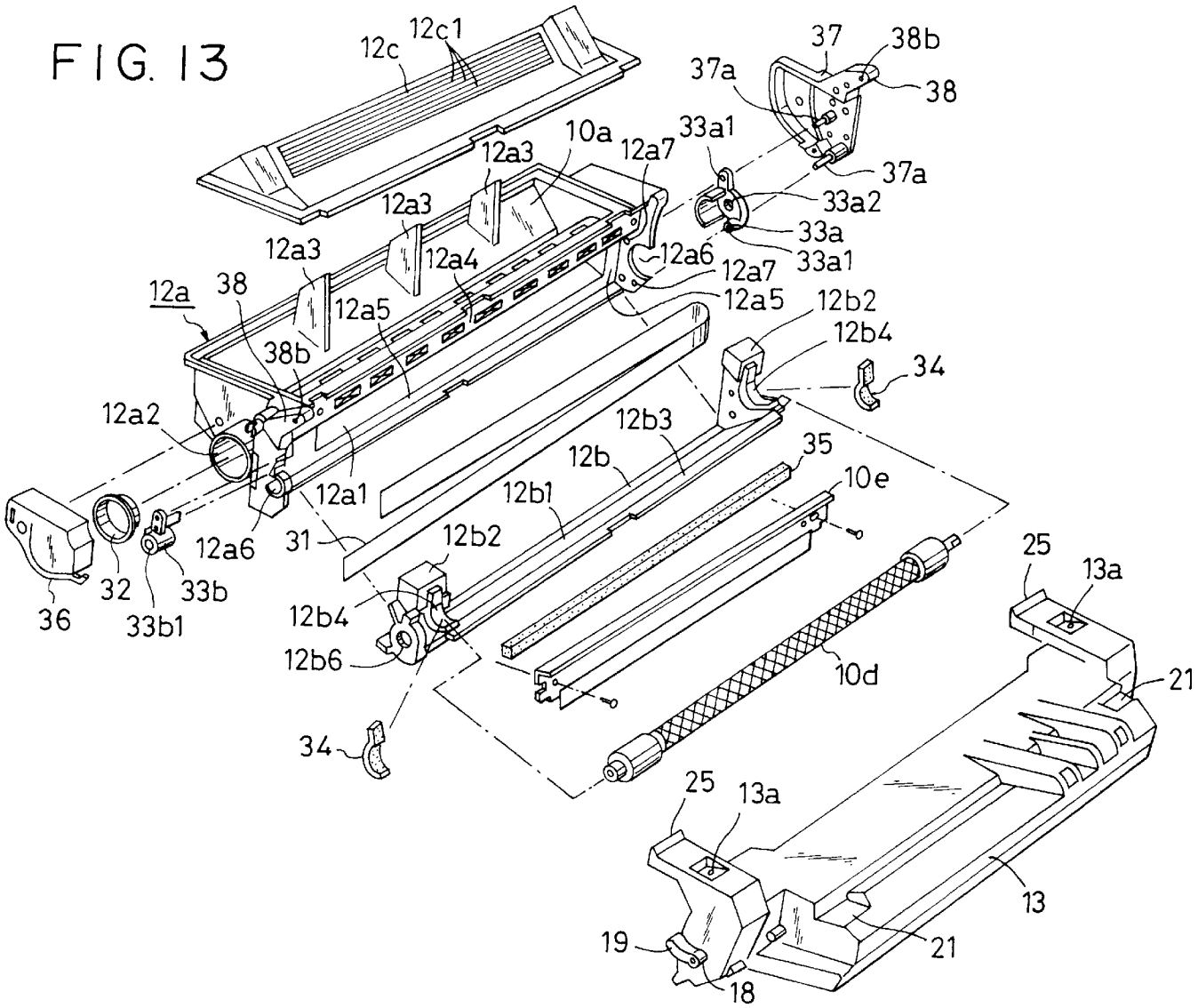
FIG. 13 is an explanatory exploded drawing of an entire cartridge frame.

Next, the structure of an entire cartridge frame will be described. The entire cartridge frame is made up, as shown in FIG. 13, by welding a support frame 12*b* which is a second frame to one side of a development frame 12*a* which i s a first frame and welding a cover frame 12*c* to the top thereof to constitute a toner development frame 12, and then joining a cleaning frame 13 to the toner development frame 12, these frames being each formed by injection molding of polystyrol resin.

The development frame 12*a* has a toner supply opening 12*a*1 formed in one side and a toner filling port 12*a*2 formed in one of both lateral surfaces spaced in the longitudinal direction. Also, a plurality of support members 12*a*3 are vertically provided in the development frame 12*a* with intervals in the longitudinal direction.

When assembling the developing means, a toner sealing member 31 in the form of a film is welded to a sticking seat 12*a*5 formed around the toner supply opening 12*a*1 of the development frame 12*a*, thereby sealing the opening 12*a*1, and the cover frame 12*c* is welded to the development frame 12*a* after incorporating the first toner feeding member 10*b*1 in the development frame 12*a*. The toner is filled into the development frame 12*a* through the filling port 12*a*2 and, thereafter, a cap 32 is fitted to the filling port 12*a*2 to seal the toner accommodating portion 10*a*.

Figure 14:
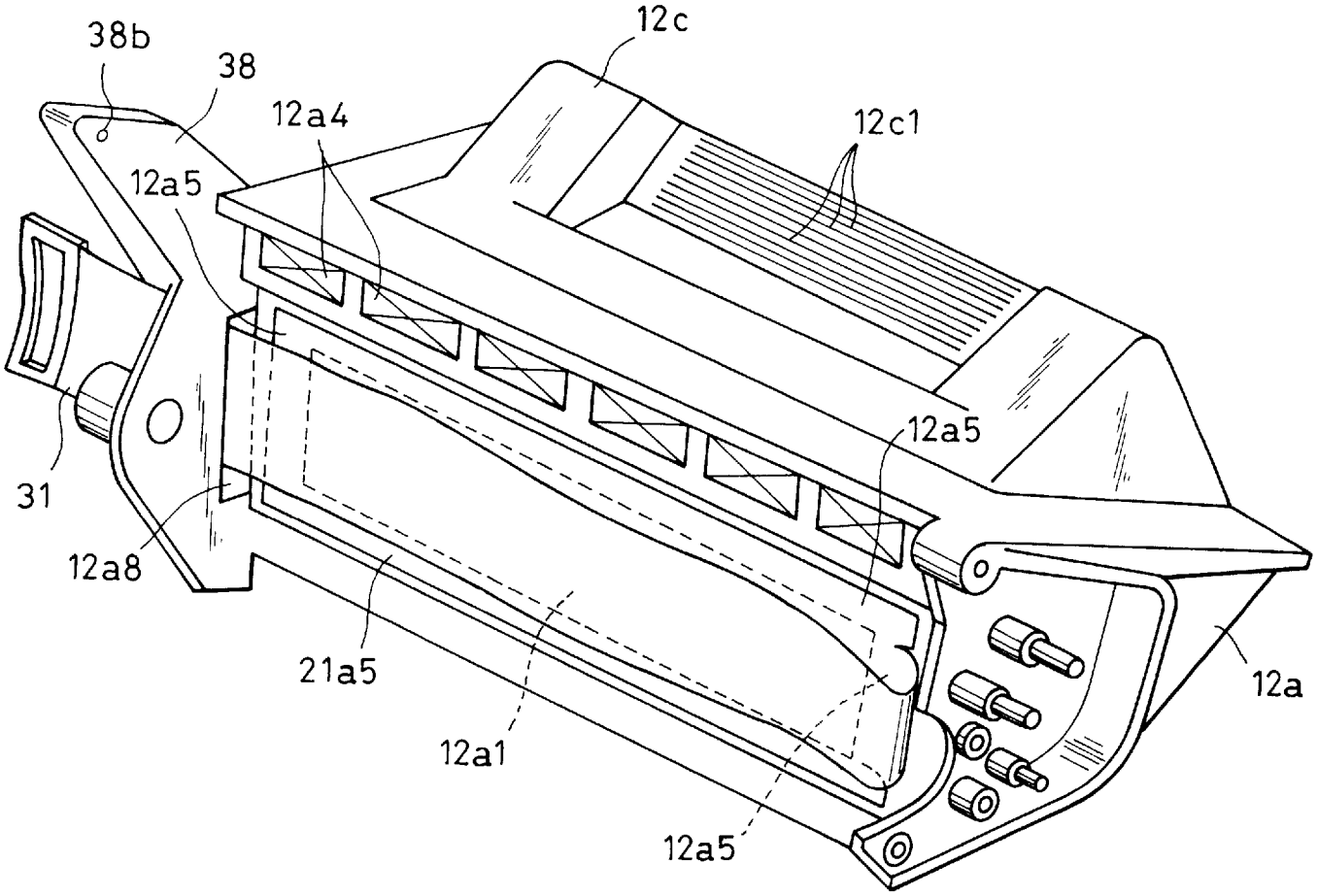
FIG. 14 is an explanatory drawing depicting the state of a toner sealing member being attached to the development frame.

Additionally, as shown in FIG. 14, the toner sealing member 31 attached to seal the opening 12*a*1 is folded back from one end of the opening 12*a*1 in the longitudinal direction and its free end is extended out through a slit 12*a*8 formed in the development frame 12*a*. When the process cartridge B is used, the users pull and remove the toner sealing member 31 while holding the free end.

{Structure for Joining Development Frame and Support Frame}

Next, the support frame 12*b* which is a second frame is welded to one side of the development frame 12*a* which is a first frame for joining both frames together. The second toner feeding member 10*b*2 and toner leakage preventing seals 34 made of foamed urethane or the like are attached to the support frame 12*b*. Then, bearing members 33*a*, 33*b* are attached to the support frame and the development roller 10*d* is rotatably supported at both its ends by the bearing members 33*a*, 33*b*.

Figure 15:
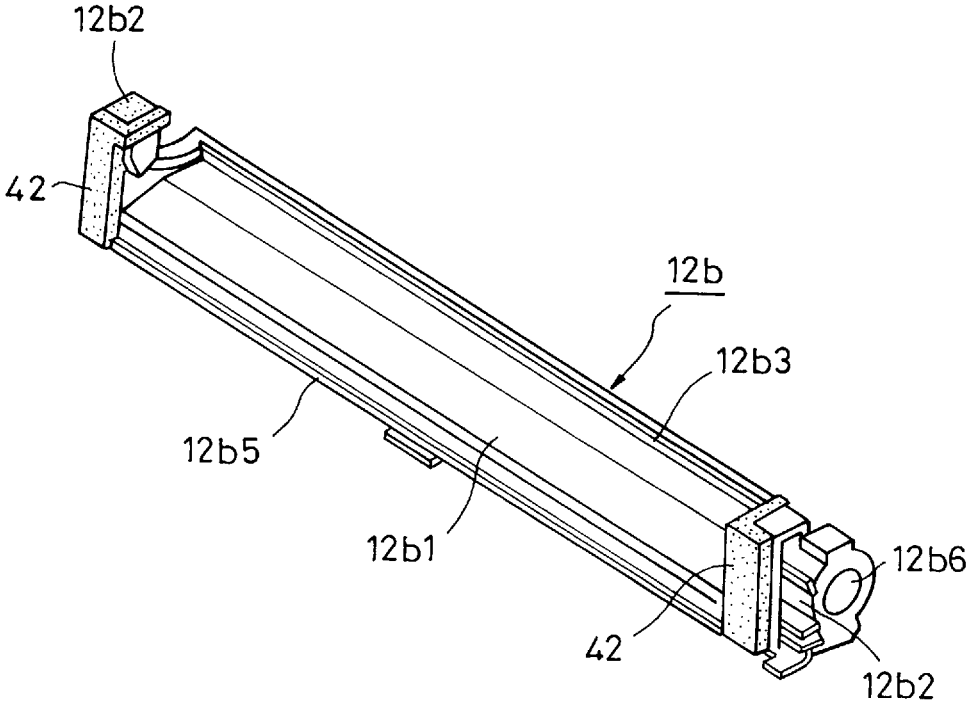
FIG. 15 is an explanatory drawing depicting the rear side of the support frame.

More specifically, as shown in FIG. 13, a mounting seat 12*a*4 for the development blade 10*e* is provided in an upper portion of the development frame 12*a* to extend in the longitudinal direction, the sticking seat 12*a*5 for the toner sealing member 31 is provided around the toner supply opening 12*a*1, and partly circular holes 12*a*6 are formed in both longitudinal ends of the development frame 12*a*. The support frame 12*b*, which is in the form of a channel section, comprises a longitudinal portion 12*b*1 and sealing portions 12*b*2 provided at both ends of the longitudinal portion 12*b*1. A blow-off sheet sticking seat 12*b*3 is provided on the front side of the longitudinal portion 12*b*1, and an arc-shaped seal sticking seat 12*b*3 is provided on the front side of each of the sealing portion 12*b*2. Also, as shown in FIG. 15, one weld rib 12*b*5 is formed on the rear side of the longitudinal portion 12*b*1, and a toner leakage preventing seal 42 is stuck to the rear side of each of the sealing portion 12*b*2. Further, one of the sealing portions 12*b*2 is provided with a hole 12*b*6 into which the bearing member 33*b* is fitted.

Figure 1:
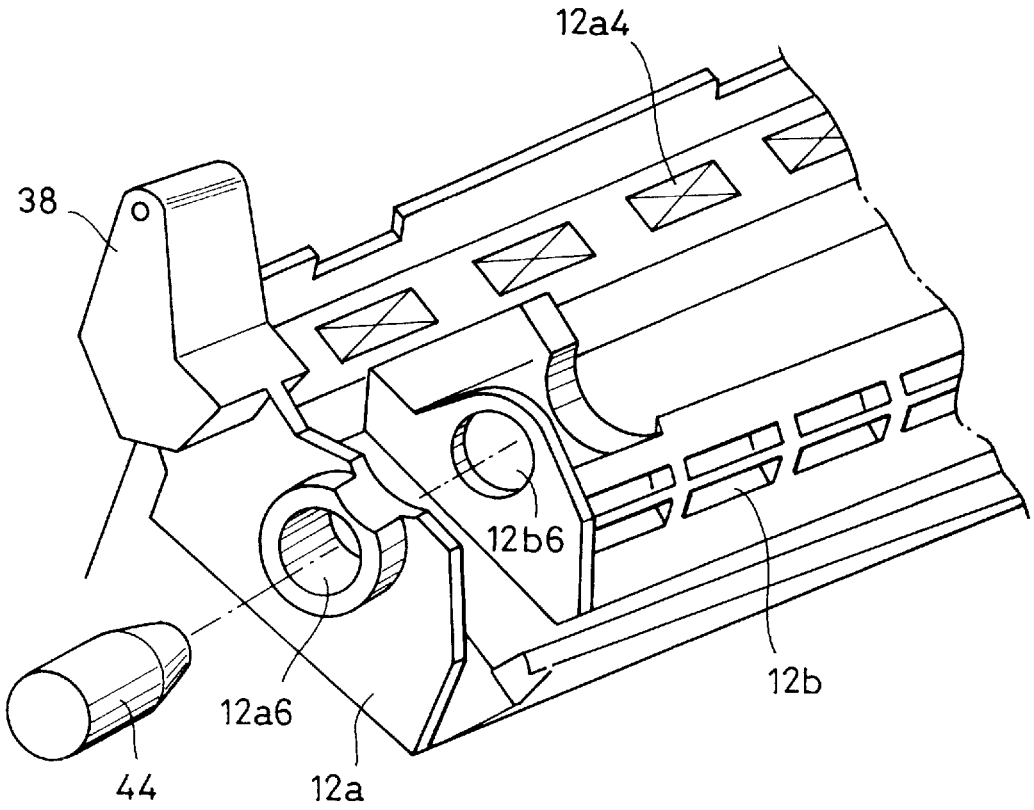
FIG. 1 is an explanatory drawing depicting the structure for positioning a development frame and a support frame.

After incorporating the second toner feeding member 10*b*2 in the support frame 12*b*, the support frame 12*b* is integrally joined to the development frame 12*a* by ultrasonic welding. The position accuracy resulted in welding together the development frame 12*a* and the support frame 12*c* in turn determines the positional relationship of the development blade 10*e*, the toner leakage preventing seals 34 and a blow-off sheet 43 relative to the development roller 10*d* which is assembled later. For this reason, it is required to increase the position accuracy between the development frame 12*a* and the support frame 12*b*. A positioning means for satisfying that requirement is constituted as shown in FIG. 1. Specifically, holes 12*a*6, 12*b*6 are formed respectively in the development frame 12*a* and the support frame 12*b* to be concentric with the rotation axis of the development roller 10*d*, and a positioning shaft 44 is inserted through the holes 12*a*6, 12*b*6. It is to be here noted that the axis or linear center line penetrating the holes 12*a*6, 12*b*6 is aligned with the rotation axis of the development roller 10*d* and is parallel to the weld rib 12*b*5.

Figure 2:
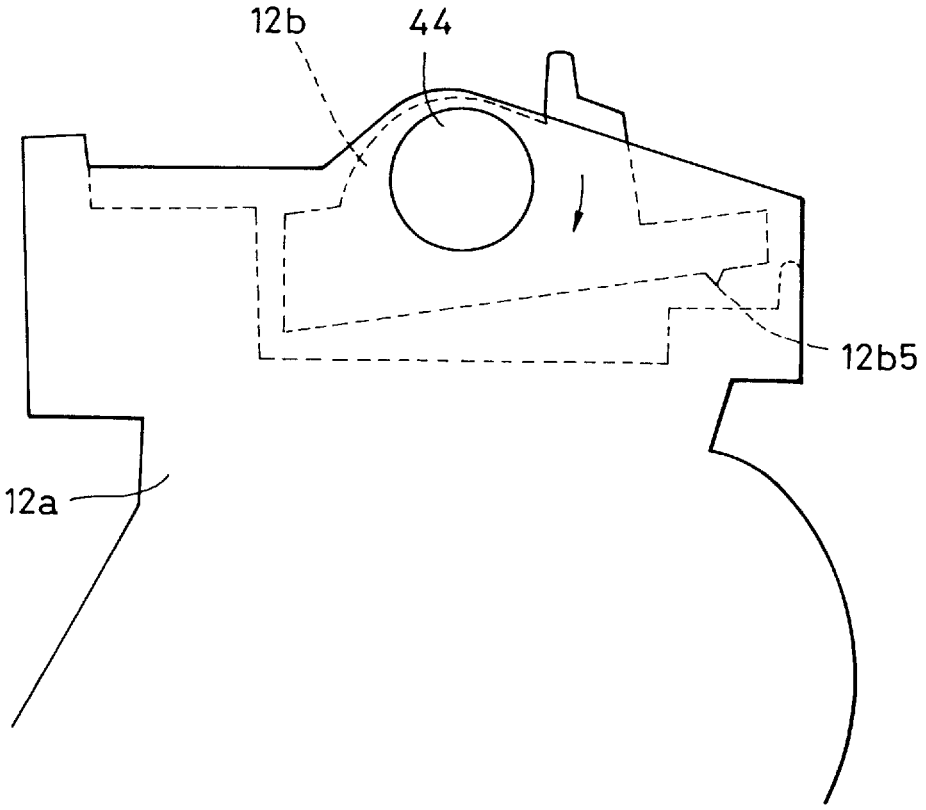
FIG. 2 is an explanatory drawing depicting the manner of welding together the development frame and the support frame while positioning both frames.

The development frame 12*a*and the support frame 12*b* are thus rotatably connected about the shaft 44 using the above positioning means and, in this connected state, the support frame 12*b* is joined at the weld rib 12*b*5 to a portion of the development frame 12*a* below the toner supply opening 12*a*1 by ultrasonic welding. At this time, as shown in FIG. 2, the weld rib 12*b*5 is welded while being pressed to move along an arc-shaped path about the shaft 44 (in the direction of arrow in FIG. 2). Regardless of the welding conditions, therefore, there occur no offsets in the positional relationship of the development frame 12*a* and the support frame 12*b* relative to the rotation axis S (see FIG. 3) of the development roller 10*d* between the states before and after the welding step. Incidentally, the shaft 44 is removed after the development frame 12*a* and the support frame 12*b* have been joined together by ultrasonic welding.

The positional relationship of the development blade mounting seat 12*a*4 relative to the rotation center of the development roller 10*d* is ensured because the seat 12*a*4 is integrally provided on the development frame 12*a* as a one-piece part. Similarly, the positional relationship of the blow-off sheet sticking seat 12*b*3 relative to the rotation center of the development roller 10*d* is also ensured because the seat 12*b*3 is integrally provided on the support frame 12*b* as a one-piece part. Therefore, by welding together the development frame 12*a* and the support frame 12*b* in such a manner that the rotation centers of the development roller 10*d* defined by both frames are perfectly aligned with each other, as stated above, the blade mounting seat 12*a*4, the blow-off sheet sticking seat 12*b*3 and the seal sticking seats 12*b*4 can be positioned in the toner development frame 12, which is obtained after integrally welding together both frames 12*a*, 12*b*, with high precision relative to the rotation center of the development roller 10*d*.

Additionally, in this embodiment, when the development frame 12*a* and the support frame 12*b* have been joined together by ultrasonic welding, the toner leakage preventing seals 42 stuck to the sealing portions 12*b*2 on the rear side thereof are each positioned on a transverse portion of the sticking seat 12*a*5 for the sealing member 31 which is heat sealed to the development frame 12*a*.

Figure 3:
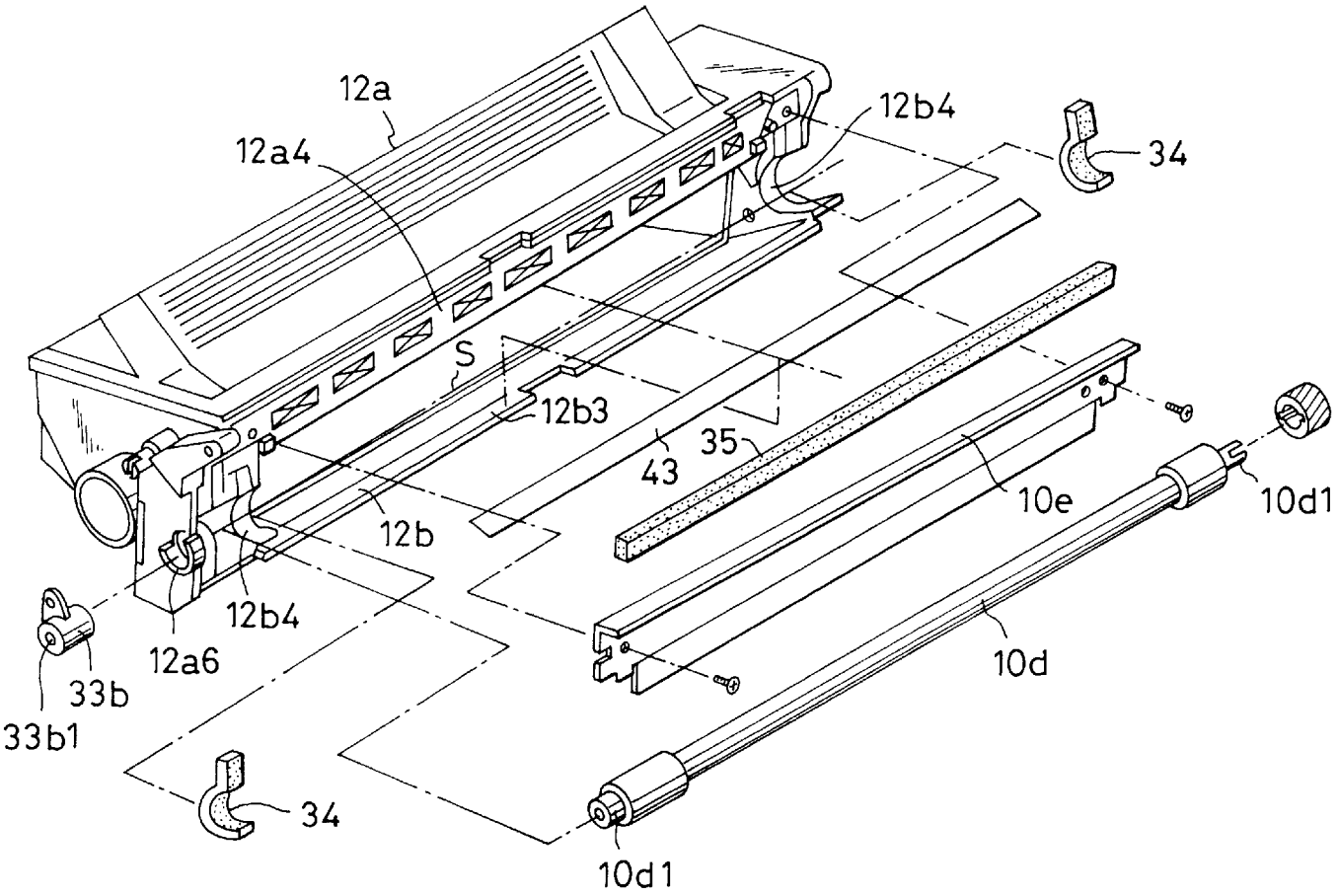
FIG. 3 is an explanatory drawing depicting how various members are assembled on a toner development frame.

For the toner development frame 12 thus fabricated, as shown in FIG. 3, the toner leakage preventing seals 34 are stuck to the seal sticking seats 12*b*4, a toner leakage preventing seal 34 made of foamed urethane or the like is stuck to a lower portion of the blade mounting seat 12*a*4, and the development blade 10*e* is screwed to the blade mounting seat 12*a*4. Further, the development roller 10*d* is mounted after sticking the blow-off sheet 43 to the sticking sheet 12*b*3. The development roller 10*d* is mounted by fitting shaft portions 10*d*1 formed at both ends of the development roller 10*d* into the shaft holes 33*a*2, 33*b*1 of the bearing members 33*a*, 33*b* such that the development roller 10*d* is rotatably supported by the bearing members 33*a*, 33*b*. The bearing members 33*a*, 33*b* are positioned so as to line up with the rotation axis S of the development roller 10*d* which is penetrating the toner development frame 12 and the support frame 12*b* having been so aligned when welded together. One 33*b* of the bearing members receives at its inner periphery a flange of the development roller 10*d*.

After assembling the developing means as described above, a link support member 36 shown in FIG. 13 is attached to one longitudinal end of the toner development frame 12 in covering relation to the cap 32, and a gear train (not shown) for transmitting the driving force to the photosensitive drum 7, the development roller 10*d*, etc. is assembled onto the other longitudinal end of the toner development frame 12. A gear cover 37 is then attached in covering relation to the gear train. The gear cover 37 is provided with a positioning shaft 37*a* which is inserted through a hole 33*a* 1 of the bearing member 33*a* and a hole 12*a*7 of the development frame 12*a* for positioning. The gear cover 37 is fixedly attached to the development frame 12*a* by using latch pawls, screws or the like.

An arm portion 38 which serves as a joint portion is integrally formed at one longitudinal end of the development frame 12*a*, and another arm portion 38 which also serves as a joint portion is integrally formed on the gear cover 37 attached to the other longitudinal end of the development frame 12*a* (see FIG. 13).

Then, the toner development frame 12 on which the various members making up the developing means have been assembled and the cleaning frame 13 on which the photosensitive drum 7, the charging roller 8 and various members making up the cleaning means 11 have been assembled are joined together through the arm portions 38, thereby constituting the process cartridge B.

Figure 16:
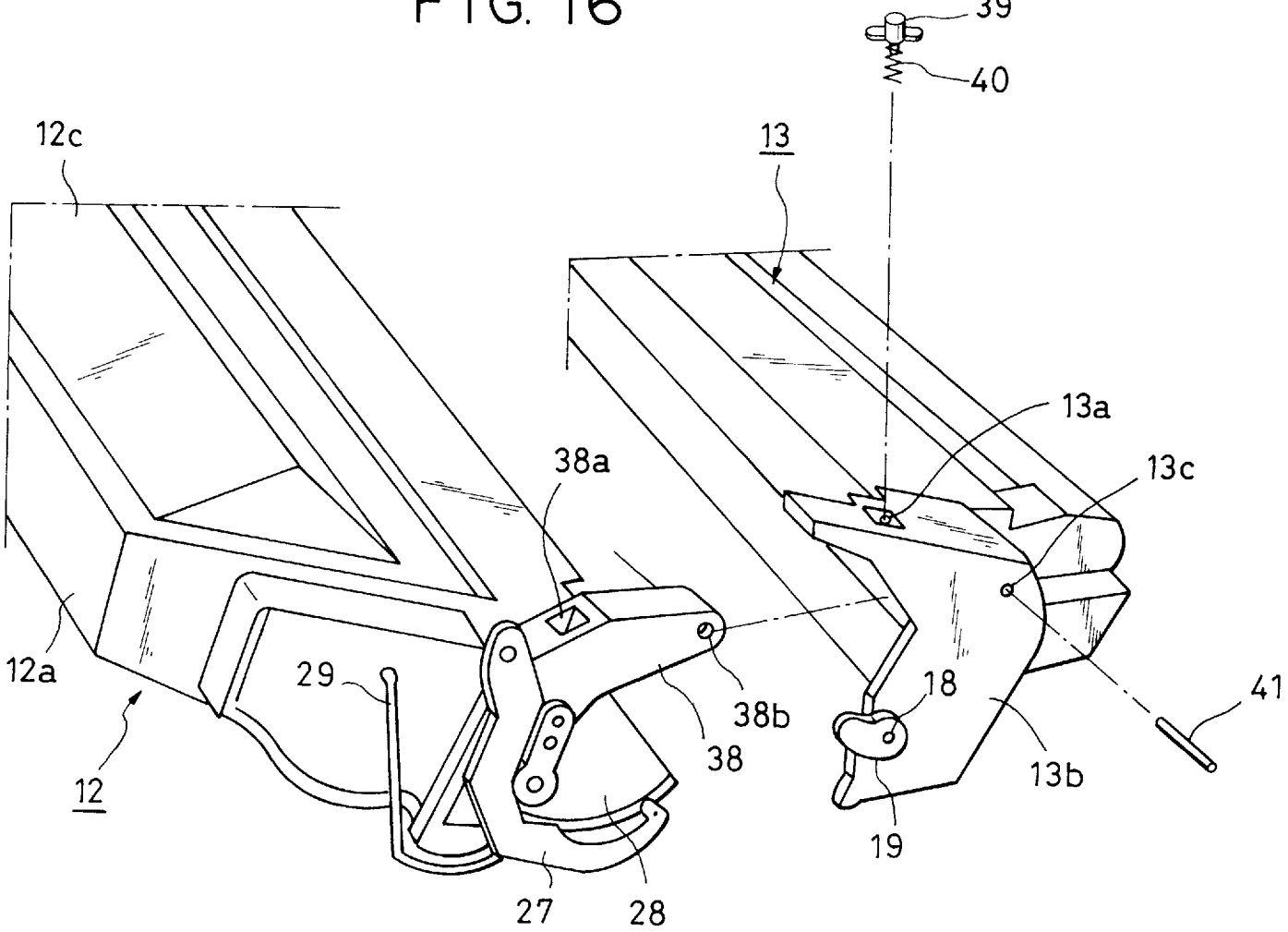
FIG. 16 is an explanatory perspective view depicting the state before the toner development frame and a cleaning frame are joined together.
Figure 17:
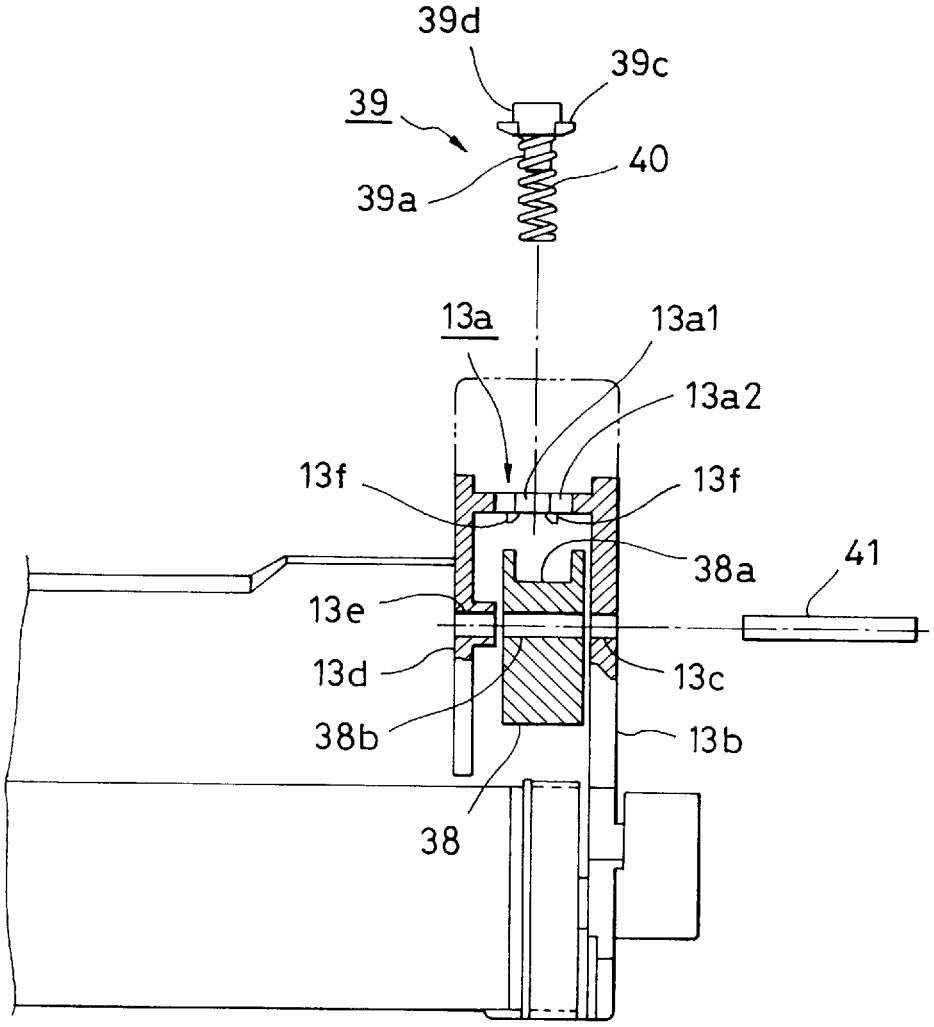
FIG. 17 is an explanatory drawing depicting the internal structure of both joined portions of the toner development frame and the cleaning frame.
Figure 18:
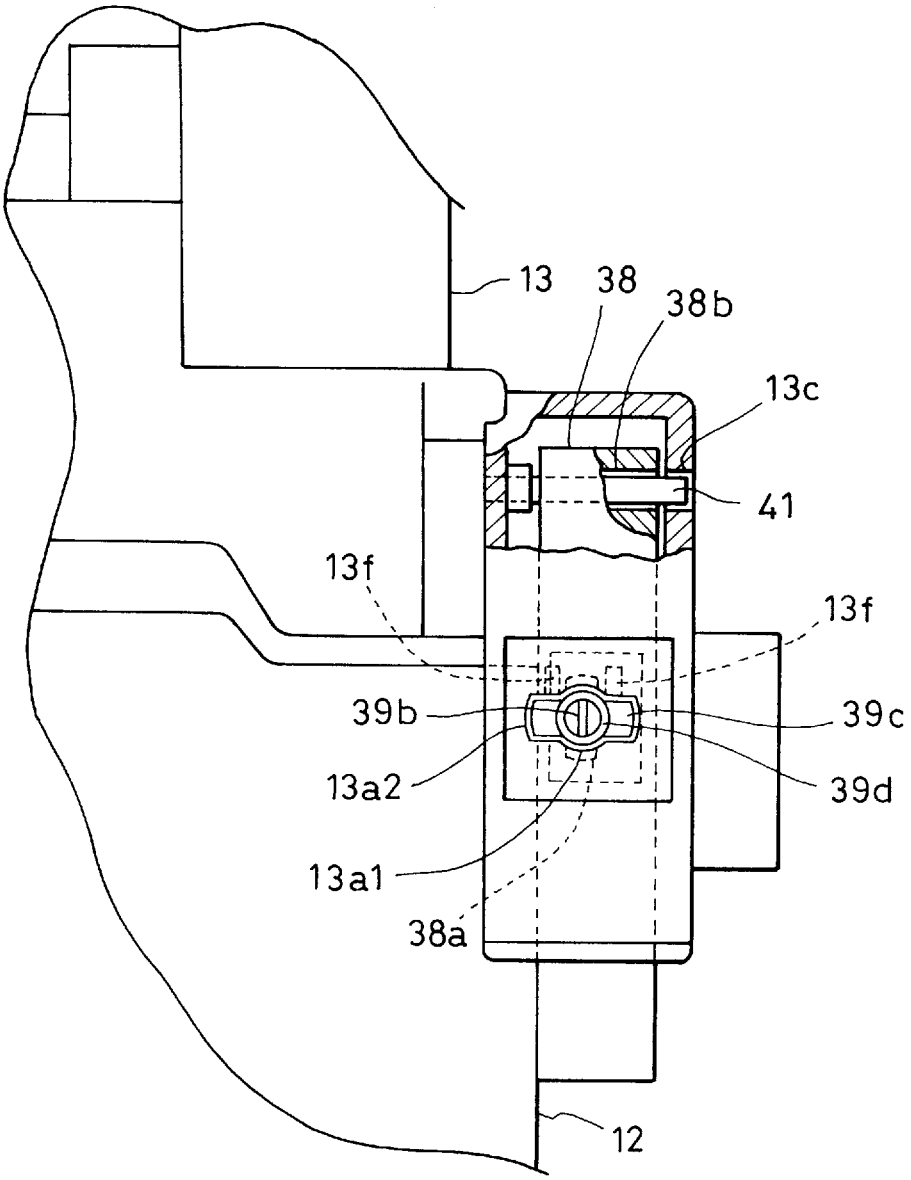
FIG. 18 is a schematic explanatory plan view depicting both joined portions of the toner development frame and the cleaning frame.
Figure 19:
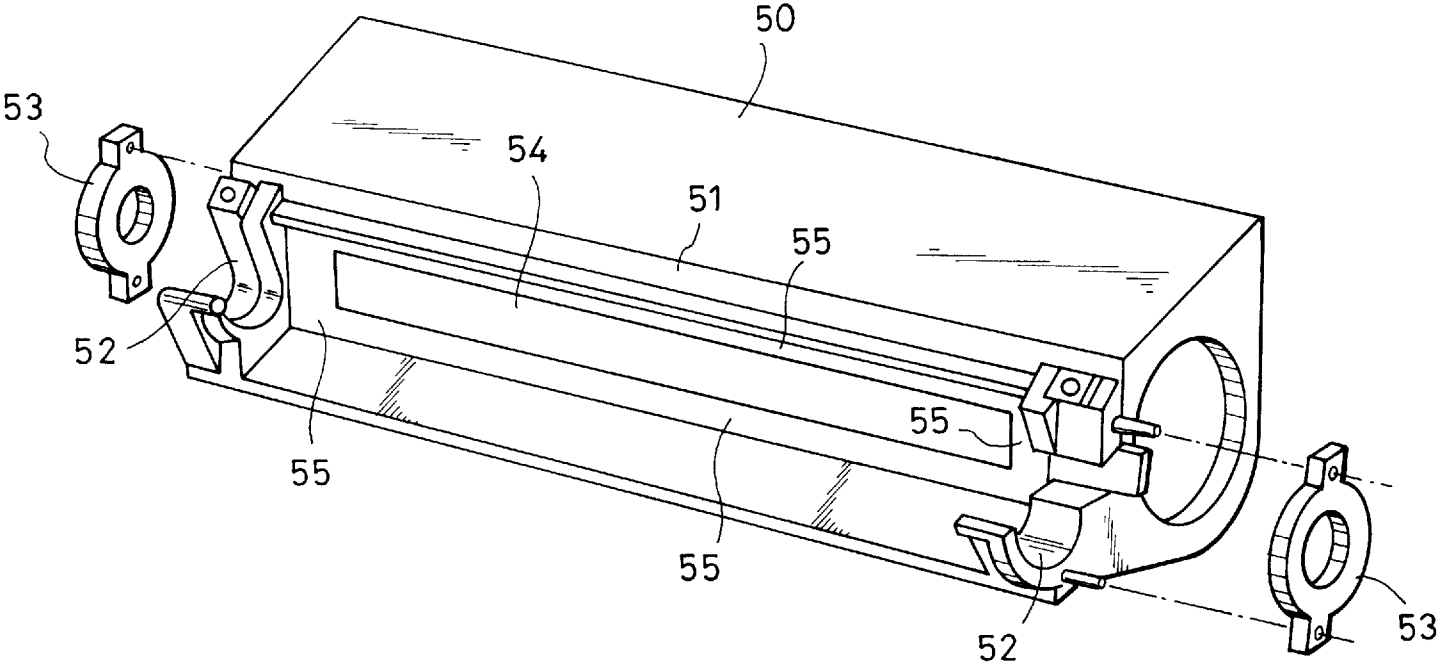
FIG. 19 is an explanatory drawing depicting the background art.

Next, referring to FIGS. 16–18 the structure for joining the development frame 12 and the cleaning frame 13 will be described. FIG. 16 is a perspective view of both frames 12 and 13, depicting how they are joined. FIG. 17 depicts the internal structure of the joint, and FIG. 18 is a partially cutaway schematic plan view of the joint. The structures of the left and right joints at which the frames 12 and 13 are rotatively connected to each other with the arm portions 38 are the same; therefore, the structure on only one side will be described.

Referring to FIGS. 17 and 18 in order to give some elastic flexibility to the angle formed between the development frame 12 and the cleaning frame 13, the process cartridge B is provided with a compression spring 40, which is attached to a compression spring anchoring member 39 which integrally comprises a spring attachment portion 39*a* and a cylindrical portion 39*d*. The cylindrical portion 39*d* has a larger diameter than the diameter of the compression spring 40 attached to the spring attachment portion 39*a*. The head portion of the cylindrical portion is provided with a rib 39*b*, and the peripheral surface of the cylindrical portion 39*d* is provided with two flanges 39*c*.

The upward facing surface of the arm portion 38 of the development frame 12 is provided with a recess 38*a* (receiving portion). The location of the recess 38*a* is such that after the development frame 12 and the cleaning frame 13 are rotatively joined as will be described later, the recess 38*a* is located right below the attachment hole 13*a* of the cleaning frame 13. Further, a through hole 38*b* through which a pin 41 is put is provided at the tip portion of the arm portion 38. The pin 41 will be described later.

On the other hand, the cleaning frame 13 is provided with an attachment hole 13*a* into which the aforementioned spring anchoring member 39 is pressed. Referring to FIGS. 17 and 18 the attachment hole 13*a* is constituted of a cylindrical hole portion 13*a*1 slightly larger than the flange 39*c* or the cylindrical portion 39*d* of the spring anchoring member 39, and a cutaway portion 13*a*2. The external wall 13*b* of the cleaning frame 13 is provided with a hole 13*c* through which the pin 41 is put, and the internal wall 13*d* of the cleaning frame 13 is provided with a hole 13*e* into which the pin 41 is pressed. The axial lines of the holes 13*c* and 13*e* coincide with each other, and are parallel to the axial lines of the holes 13*c* an d 13*e* provided on the other side, relative to the longitudinal direction, of the cleaning frame 13. Further, a rib 13*f* is provided on the interior surface of the cleaning frame 13, adjacent to the attachment hole 13*a*.

Referring to FIGS. 17 and 18, when the development frame 12 and cleaning frame 13 are joined using the above structure, first, the arm portion 38 of the development frame 12 is inserted into the joining portion 13*h* of the cleaning frame 13. Next, the pin 41 is put through the hole 13*c* of the cleaning frame 13, and the through hole 38*b* of the arm portion 38, in this order, and then is pressed into the hole 13*e*. As a result, the development frame 12 and cleaning frame 13 are joined in such a manner that they are rotatable about the pin 41. At this stage of the process cartridge B assembly, no pressure is present to press the photosensitive drum 7 and development roller 10*d* toward each other; therefore, assembly workers can easily examine the degree of the rotatability of both components.

Next, referring to FIG. 17, the spring anchoring member 39 to which the spring 40 has been attached is put through the attachment hole 13*a*; the cutaway portion 13*a*2 of the attachment hole 13*a*, and the flange 39*c* of the spring anchoring member 39, are aligned, with the tip of the spring 40 placed in contact with the bottom surface of the recess 38*a*, and the spring anchoring member 39 is pressed straight down in the compressing direction of the spring 40 until the upper surface of the flange 39*c* of the spring anchoring member 39 comes to be located below the rib 13*f*, and the cylindrical portion 39*d* comes to be guided by the cylindrical hole portion 13*a*1 of the attachment hole 13*a*. In this state, the spring anchoring member 39 is rotated 90°, and is released. Consequently, the spring anchoring member 39 is pushed up, being guided by the cylindrical hole portion 13*a*1, by the resiliency of the spring 40, and is stopped at a point at which the flange 39*c* strikes the bottom edge of the attachment hole 13*a*.

As a result, the development roller 10*d* mounted in the development frame 12 is pressed toward the photosensitive drum 7 mounted in the cleaning frame 13, coming in contact with the ring members (unillustrated) as spacers mounted at the longitudinal ends of the development roller 10*d*, and thereby coming to be accurately positioned relative to the photosensitive drum 7. At the same time, the drum gear fixed to the longitudinal end of the photosensitive drum 7 becomes engaged with a roller gear fixed to the longitudinal end of the development roller 10*d*, enabling the driving force to be transmitted.

Thus, by rotatably joining the toner development frame 12 and the cleaning frame 13, confirming the rotating states of the photosensitive drum 7 and the development roller 10*d*, and thereafter pushing down the spring anchoring member 39 to urge the photosensitive drum 7 and the development roller 10*d* toward each other, there is no risk of causing variations in the force pressing the development roller 10*d* against the photosensitive drum 7. Also, since the spring anchoring member 39 is attached by being pushed down in the compressing direction of the compression spring 40 fitted on the spring anchoring member 39, there is no risk of causing the compression spring 40 to buckle. Further, when the spring anchoring member 39 is to be replaced, it can be replaced by another while keeping the toner development frame 12 and the cleaning frame 13 joined together, with no need of removing a cover fitted to cover spring unlike the prior art. Regardless of the cartridge assembly procedure, therefore, the spring anchoring member 39 provided with a spring having proper resiliency can be placed as needed.

Accordingly, the assembly efficiency of the process cartridge B is improved. When an image is formed by using the process cartridge B, the image can be produced with high quality because there are no variations in the pressing force exerted from the development roller 10*d* as described above.

{Other Embodiment}

Next, various components of the process cartridge B and the image forming apparatus in accordance with the present invention will be described.

Further, the aforementioned process cartridge B was of a type for forming a monochromatic image. However, not only is the present invention preferably applicable to the process cartridge which forms a monochromatic image, but also to a cartridge which comprises two or more developing means, and forms a multi-color image (for example, a two-color image, a three-color image, a full-color image, and the like).

As for the developing method, various known development methods such as the magnetic brush development method employing two component toner, the cascade development method, the touch down development method, or cloud development method may be employed.

The electro-photographic photosensitive member is not limited to the photosensitive drum. For example, the following may be included.

First, as the photosensitive material, photoconductive material such as amorphous silicon, amorphous selenium, zinc oxide, titanium oxide, or organic photoconductor (OPC) may be included. As for the shape of the base member on which the photosensitive material is placed, a rotary member such as a drum or a member in the form of a sheet such as an endless belt, are included. Generally, a member in the form of a drum or a belt is employed. For example, a photosensitive drum comprises a cylinder of aluminum alloy or the like, and photoconductive material deposited or coated thereon.

The structure of the charging means described in the preceding embodiment was of the so-called contact type, but it is obvious that other conventional structures may be employed, for example, a structure in which a tungsten wire is surrounded on three sides by a shield of metallic material such as aluminum, and positive or negative ions generated by applying a high voltage to the tungsten wire are transferred onto the surface of the photosensitive drum to uniformly charge the drum surface.

As for the charging means, a charging means of the blade type (charging blade), the pad type, the block type, the rod type, the wire type, or the like may be employed in addition to the roller type charging means described in the preceding embodiment.

Regarding the method for cleaning the toner remaining on the photosensitive drum, the cleaning means may comprise a blade, a fur brush, a magnetic brush, or the like.

Typical forms of the aforementioned process cartridge include, e.g., one wherein the developing means, the electrophotographic photosensitive member, the charging means, and the cleaning means are integrally mounted in a cartridge which is detachably mounted in the image forming apparatus; one wherein the developing means, the electrophotographic photosensitive member, and the charging means or the cleaning means are integrally mounted in a cartridge which is detachably mounted in the image forming apparatus; and one wherein the developing means and the electrophotographic photosensitive member are integrally mounted in a cartridge which is detachably mounted in the image forming apparatus.

While the preceding embodiment was described in connection with a laser beam printer as one example of image forming apparatus, the present invention is not necessarily limited thereto, but may be of course applied to other types of image forming apparatus such as an electrophotographic copying machine, a facsimile and a word processor.

As described above, when joining together the first and second frames by welding, a weld portion is provided so as to extend along a straight line, a positioning means common to both frames is provided so as to extend along a straight line parallel to the straight weld portion, and both frames are welded together while they are rotatably supported by the positioning means. This prevents offsets from being brought in the positioning common to both frames. As a result, it is possible to improve the relative position accuracy of both frames after the welding, simplify the control necessary for maintaining the welding conditions, and increase productivity of the process cartridge.

Further, when joining together the first and second frames by welding, the toner leakage preventing seals can be placed over the sticking seat of the toner sealing member employed to seal the toner supply port. It is therefore possible to reduce the size of the process cartridge and hence the size of the image forming apparatus in which the process cartridge is mounted.

What is claimed is:

1. A process cartridge detachably mountable to a main assembly of an electrophotographic image forming apparatus, comprising:

an electrophotographic photosensitive drum;

a development roller for developing a latent image formed on said electrophotographic photosensitive drum;

a development frame including a toner accommodating portion for accommodating toner to be used by said development roller for development, and a development blade for forming a toner layer over a circumferential surface of said development roller;

a photosensitive drum frame for supporting said electrophotographic photosensitive drum; and a support frame including a first toner leakage preventing member to be positioned at one longitudinal end of said development roller and a second toner leakage preventing member to be positioned at the other longitudinal end of said development roller;

wherein said development frame and said support frame are rotatably connected about a positioning member and, in this connected state, a portion of said development frame and a portion of said support frame are welded to each other so that said development frame and said support frame are joined together.

2. A process cartridge according to claim 1, wherein said positioning member comprises a shaft, said shaft penetrating respective holes which are formed in said development frame and said support frame to be concentric with a rotation axis of said development roller.

3. A process cartridge according to claim 1 or 2, wherein said development frame comprises a toner supply opening through which the toner accommodated in said toner accommodating portion is supplied to said development roller, and wherein said development frame and said support frame are joined together at a portion of said development frame below said toner supply opening by fusing a weld rib by ultrasonic welding.

4. A process cartridge according to claim 3, wherein said positioning member is provided to extend substantially parallel to the direction in which said weld rib for welding together a portion of said development frame and a portion of said support frame is extended, and wherein said weld rib is welded by ultrasonic welding to join together said development frame and said support frame.

5. A process cartridge according to claim 1, wherein said development roller is rotatably supported such that shaft portions formed at longitudinal opposite ends of said development roller are fitted respectively in shaft holes of bearing members positioned corresponding to the longitudinal opposite ends of said development roller, said bearing members being attached onto said development frame.

6. A process cartridge according to claim 1 or 5, wherein said photosensitive drum frame is pivotally connected to said development frame and said support frame both joined together.

7. A process cartridge according to claim 1 or 5, wherein a toner seal for sealing a toner supply opening is attached to said development frame, said toner seal for being removed before use of said process cartridge.

8. A process cartridge detachably mountable to a main assembly of an electrophotographic image forming apparatus, comprising:

an electrophotographic photosensitive drum;

a charging roller for charging said electrophotographic photosensitive drum;

a development roller for developing a latent image formed on said electrophotographic photosensitive drum;

a cleaning blade for removing toner remaining on said electrophotographic photosensitive drum;

a photosensitive drum frame for supporting said electrophotographic photosensitive drum;

a development frame comprising a toner accommodating portion for accommodating toner to be used by said development roller for development, a toner supply opening through which the toner accommodated in said toner accommodating portion is supplied to said development roller, a toner seal attached thereto for sealing said toner supply opening, said toner seal for being removed before use of said process cartridge, and a development blade for forming a toner layer over a circumferential surface of said development roller; and a support frame including a first toner leakage preventing member to be positioned at one longitudinal end of said development roller and a second toner leakage preventing member to be positioned at the other longitudinal end of said development roller, wherein said development frame and said support frame are rotatably connected about a shaft as a positioning member and, in this connected state, a portion of said development frame and a portion of said support frame are joined together by ultrasonic welding, said shaft penetrating respective holes formed in said development frame and said support frame, said development frame and said support frame both joined together being pivotally connected to said photosensitive drum frame.

9. A process cartridge according to claim 8, wherein said development frame and said support frame are joined together at a portion of said development frame below said toner supply opening by fusing a weld rib by ultrasonic welding.

10. A process cartridge according to claim 8 or 9, wherein said shaft is provided to extend substantially parallel to the direction in which a weld rib for welding together a portion of said development frame and a portion of said support frame is extended, and wherein said weld rib is welded by ultrasonic welding to join together said development frame and said support frame.

11. A process cartridge according to claim 10, wherein said holes through which said shaft penetrates are formed to be concentric with the rotation axis of said development roller.

12. An assembling method of a process cartridge detachably mountable to a main assembly of an electrophotographic image forming apparatus, comprising the steps of:

preparing an electrophotographic photosensitive drum;

preparing a development roller for developing a latent image formed on said electrophotographic photosensitive drum;

preparing a development frame including a toner accommodating portion for accommodating toner to be used by said development roller for development, and including a development blade for forming a toner layer over a circumferential surface of said development roller;

mounting said electrophotographic photosensitive drum on a photosensitive drum frame;

attaching, to a support frame, a first toner leakage preventing member positioned at one longitudinal end of said development roller and a second toner leakage preventing member positioned at the other longitudinal end of said development roller;

connecting said development frame and said support frame rotatably about a positioning member;

relatively rotating said development frame and said support frame, which are rotatably connected about said positioning member;

welding a portion of said development frame and a portion of said support frame which are positioned through said rotating step, so that said development frame and said support frame are joined together; and connecting said photosensitive drum frame pivotally to said development frame and said support frame both joined together.

13. An assembling method of a process cartridge according to claim 12, wherein said positioning member comprises a shaft that penetrates bearing members, said shaft penetrating respective holes which are formed in said development frame and said support frame to be concentric with the rotation axis of said development roller.

14. An assembling method of a process cartridge according to claim 12 or 13, wherein said development frame comprises a toner supply opening through which the toner accommodated in said toner accommodating portion is supplied to said development roller, and wherein said development frame and said support frame are joined together at a portion of said development frame below said toner supply opening by fusing a weld rib by ultrasonic welding.

15. An assembling method of a process cartridge according to claim 12 or 13, wherein in said step of connecting said development frame and said support frame rotatably about a positioning member, said positioning member is provided to extend substantially parallel to the direction in which a weld rib for welding together a portion of said development frame and a portion of said support frame is extended, and wherein said weld rib is fused by ultrasonic welding to join together said development frame and said support frame.

16. An assembling method of a process cartridge according to claim 12 or 13, wherein said development roller is rotatably supported such that shaft portions formed at longitudinal opposite ends of said development roller are fitted respectively in shaft holes of bearing members positioned corresponding to the longitudinal opposite ends of said development roller, said bearing members being attached onto said development frame.

17. An assembling method of a process cartridge according to claim 12 or 13, wherein a toner seal for sealing said toner supply opening is attached to said development frame, said toner seal for being removed before use of said process cartridge.

18. An assembling method of a process cartridge detachably mountable to a main assembly of an electrophotographic image forming apparatus, comprising the steps of:

preparing an electrophotographic photosensitive drum;

preparing a charging roller for charging said electrophotographic photosensitive drum;

preparing a development roller for developing a latent image formed on said electrophotographic photosensitive drum;

preparing a cleaning blade for removing toner remaining on said electrophotographic photosensitive drum;

preparing a development frame including a toner accommodating portion for accommodating toner to be used by said development roller for development, and a toner supply opening through which the toner accommodated in said toner accommodating portion is supplied to said development roller;

mounting said electrophotographic photosensitive drum on a photosensitive drum frame;

mounting said charging roller on said photosensitive drum frame;

mounting said cleaning blade on said photosensitive drum frame;

attaching a toner seal to said development frame for sealing said toner supply opening of said development frame, said toner seal for being removed before use of said process cartridge;

mounting a development blade on said development frame for forming a toner layer over a circumferential surface of said development roller;

mounting said development roller on said development frame, said development roller being rotatably supported such that shaft portions formed at longitudinal opposite ends of said development roller are fitted respectively in shaft holes of bearing members positioned corresponding to the longitudinal opposite ends of said development roller, said bearing members being attached onto said development frame;

attaching, to a support frame, a first toner leakage preventing member positioned at one longitudinal end of said development roller and a second toner leakage preventing member positioned at the other longitudinal end of said development roller;

connecting said development frame and said support frame rotatably about a shaft as a positioning member, said shaft penetrating respective holes formed in said development frame and said support frame;

rotating said development frame and said support frame relative to each other which are rotatably connected about said positioning member;

fusing a portion of said development frame and a portion of said support frame by ultrasonic welding which are positioned through said rotating step, so that said development frame and said support frame are joined together; and connecting said photosensitive drum frame pivotally to said development frame and said support frame both joined together.

19. An assembling method of a process cartridge according to claim 18, wherein said development frame and said support frame are joined together at a portion of said development frame below said toner supply opening by fusing a weld rib by ultrasonic welding.

20. An assembling method of a process cartridge according to claim 18 or 19, wherein in said step of connecting said development frame and said support frame rotatably about a shaft, said shaft is provided to extend substantially parallel to the direction in which a weld rib for welding together a portion of said development frame and a portion of said support frame is extended, and wherein said weld rib is welded by ultrasonic welding to join together said development frame and said support frame.

21. An assembling method of a process cartridge according to claim 18 or 19, wherein said development roller is rotatably supported such that shaft portions formed at longitudinal opposite ends of said development roller are fitted respectively in shaft holes of bearing members positioned corresponding to the longitudinal opposite ends of said development roller, said bearing members being attached onto said development frame.

22. An electrophotographic image forming apparatus for forming an image on a recording material, wherein a process cartridge is detachably mountable to said image forming apparatus, comprising:

a mounting means for detachably mounting a process cartridge, said process cartridge including:

an electrophotographic photosensitive drum, a development roller for developing a latent image formed on said electrophotographic photosensitive drum, a development frame comprising a toner accommodating portion for accommodating toner to be used by said development roller for developments, and a development blade for forming a toner layer over a circumferential surface of said development roller, a photosensitive drum frame for supporting said electrophotographic photosensitive drum, and a support frame including a first toner leakage preventing member to be positioned at one longitudinal end of said development roller and a second toner leakage preventing member to be positioned at the other longitudinal end of said development roller, wherein said development frame and said support frame are rotatably connected about a positioning member and, in this connected state, a portion of said development frame and a portion of said support frame are welded to each other so that said development frame and said support frame are joined together; and b. feeding means for feeding said recording material.

23. An electrophotographic image forming apparatus for forming an image on a recording material, wherein a process cartridge is detachably mountable to said image forming apparatus, comprising:

a mounting means for detachably mounting a process cartridge, said process cartridge including:

an electrophotographic photosensitive drum, a charging roller for charging said electrophotographic photosensitive drum, a development roller for developing a latent image formed on said electrophotographic photosensitive drum, a cleaning blade for removing toner remaining on said electrophotographic photosensitive drum, a photosensitive drum frame for supporting said electrophotographic photosensitive drum, a development frame comprising a toner accommodating portion for accommodating toner to be used by said development roller for development, a toner supply opening through which the toner accommodated in said toner accommodating portion is supplied to said development roller, a toner seal attached thereto for sealing said toner supply opening, said toner seal for being removed before use of said process cartridge, and a development blade for forming a toner layer over a circumferential surface of said development roller, and a support frame including a first toner leakage preventing member to be positioned at one longitudinal end of said development roller and a second toner leakage preventing member to be positioned at the other longitudinal end of said development roller, wherein said development frame and said support frame are rotatably connected about a shaft as a positioning member and, in this connected state, a portion of said development frame and a portion of said support frame are joined together by ultrasonic welding, said shaft penetrating respective holes formed in said development frame and said support frame, said development frame and said support frame both joined together being pivotally connected to said photosensitive drum frame; and b. feeding means for feeding said recording material.

24. A process cartridge detachably mountable to a main assembly of an electrophotographic image forming apparatus, comprising:

an electrophotographic photosensitive drum;

a development roller for developing a latent image formed on said electrophotographic photosensitive drum;

a development frame including a toner accommodating portion for accommodating toner to be used by said development roller for development, and a development blade for forming a toner layer over a circumferential surface of said development roller;

a photosensitive drum frame for supporting said electrophotographic photosensitive drum; and a support frame including a first toner leakage preventing member to be positioned at one longitudinal end of said development roller and a second toner leakage preventing member to be positioned at the other longitudinal end of said development roller;

wherein said development frame and said support frame are rotatably connected about a portion of a positioning member that positions said development roller and, in this connected state, a portion of said development frame and a portion of said support frame are welded to each other so that said development frame and said support frame are joined together.

25. A process cartridge according to claim 24, wherein said positioning member comprises a shaft that penetrates bearing members, said shaft penetrating respective holes which are formed in said development frame and said support frame to be concentric with a rotation axis of said development roller.

26. A process cartridge according to claim 25, wherein said development frame comprises a toner supply opening through which the toner accommodated in said toner accommodating portion is supplied to said development roller, and wherein said development frame and said support frame are joined together at a portion of said development frame below said toner supply opening by fusing a weld rib by ultrasonic welding.

27. A process cartridge according to claim 26, wherein said positioning member is provided to extend substantially parallel to the direction in which said weld rib for welding together a portion of said development frame and a portion of said support frame is extended, and wherein said weld rib is welded by ultrasonic welding to join together said development frame and said support frame.

28. A process cartridge according to claim 24, wherein said development frame comprises a toner supply opening through which the toner accommodated in said toner accommodating portion is supplied to said development roller, and wherein said development frame and said support frame are joined together at a portion of said development frame below said toner supply opening by fusing a weld rib by ultrasonic welding.

29. A process cartridge according to claim 28, wherein said positioning member is provided to extend substantially parallel to the direction in which said weld rib for welding together a portion of said development frame and a portion of said support frame is extended, and wherein said weld rib is welded by ultrasonic welding to join together said development frame and said support frame.

30. A process cartridge according to claim 24, wherein said development roller is rotatably supported such that shaft portions formed at longitudinal opposite ends of said development roller are fitted respectively in shaft holes of bearing members positioned corresponding to the longitudinal opposite ends of said development roller, said bearing members being attached onto said development frame.

31. A process cartridge according to claim 30, wherein said photosensitive drum frame is pivotally connected to said development frame and said support frame both joined together.

32. A process cartridge according to claim 30, wherein a toner seal for sealing a toner supply opening is attached to said development frame, said toner seal for being removed before use of said process cartridge.

33. A process cartridge according to claim 24, wherein said photosensitive drum frame is pivotally connected to said development frame and said support frame both joined together.

34. A process cartridge according to claim 24, wherein a toner seal for sealing a toner supply opening is attached to said development frame, said toner seal for being removed before use of said process cartridge.

35. An assembling method of a process cartridge detachably mountable to a main assembly of an electrophotographic image forming apparatus, comprising the steps of:

preparing an electrophotographic photosensitive drum;

preparing a development roller for developing a latent image formed on said electrophotographic photosensitive drum;

preparing a development frame including a toner accommodating portion for accommodating toner to be used by said development roller for development, and including a development blade for forming a toner layer over a circumferential surface of said development roller;

mounting said electrophotographic photosensitive drum on a photosensitive drum frame;

attaching, to a support frame, a first toner leakage preventing member positioned at one longitudinal end of said development roller and a second toner leakage preventing member positioned at the other longitudinal end of said development roller;

connecting said development frame and said support frame rotatably about a portion of a positioning member that positions said development roller;

relatively rotating said development frame and said support frame, which are rotatably connected about said positioning member;

welding a portion of said development frame and a portion of said support frame which are positioned through said rotating step, so that said development frame and said support frame are joined together; and connecting said photosensitive drum frame pivotally to said development frame and said support frame both joined together.

36. An assembling method of a process cartridge according to claim 35, where in said positioning member comprises a shaft that penetrates bearing members, said shaft penetrating respective holes which are formed in said development frame and said support frame to be concentric with the rotation axis of said development roller.

37. An assembling method of a process cartridge according to claim 36, wherein said development frame comprises a toner supply opening through which the toner accommodated in said toner accommodating portion is supplied to said development roller, and wherein said development frame and said support frame are joined together at a portion of said development frame below said toner supply opening by fusing a weld rib by ultrasonic welding.

38. An assembling method of a process cartridge according to claim 36, wherein in said step of connecting said development frame and said support frame rotatably about a positioning member, said positioning member is provided to extend substantially parallel to the direction in which a weld rib for welding together a portion of said development frame and a portion of said support frame is extended, and wherein said weld rib is fused by ultrasonic welding to join together said development frame and said support frame.

39. An assembling method of a process cartridge according to claim 36, wherein said development roller is rotatably supported such that shaft portions formed at longitudinal opposite ends of said development roller are fitted respectively in shaft holes of bearing members positioned corresponding to the longitudinal opposite ends of said development roller, said bearing members being attached onto said development frame.

40. An assembling method of a process cartridge according to claim 36, wherein a toner seal for sealing said toner supply opening is attached to said development frame, said toner seal for being removed before use of said process cartridge.

41. An assembling method of a process cartridge according to claim 35, wherein said development frame comprises a toner supply opening through which the toner accommodated in said toner accommodating portion is supplied to said development roller, and wherein said development frame and said support frame are joined together at a portion of said development frame below said toner supply opening by fusing a weld rib by ultrasonic welding.

42. An assembling method of a process cartridge according to claim 35, wherein in said step of connecting said development frame and said support frame rotatably about a positioning member, said positioning member is provided to extend substantially parallel to the direction in which a weld rib for welding together a portion of said development frame and a portion of said support frame is extended, and wherein said weld rib is fused by ultrasonic welding to join together said development frame and said support frame.

43. An assembling method of a process cartridge according to claim 35, wherein said development roller is rotatably supported such that shaft portions formed at longitudinal opposite ends of said development roller are fitted respectively in shaft holes of bearing members positioned corresponding to the longitudinal opposite ends of said development roller, said bearing members being attached onto said development frame.

44. An assembling method of a process cartridge according to claim 35, wherein a toner seal for sealing said toner supply opening is attached to said development frame, said toner seal for being removed before use of said process cartridge.

45. An electrophotographic image forming apparatus for forming an image on a recording material, wherein a process cartridge is detachably mountable to said image forming apparatus, comprising:

a. mounting means for detachably mounting a process cartridge, said process cartridge including:
   an electrophotographic photosensitive drum,
   a development roller for developing a latent image formed on said electrophotographic photosensitive drum,
   a development frame comprising a toner accommodating portion for accommodating toner to be used by said development roller for development, and a development blade for forming a toner layer over a circumferential surface of said development roller,
   a photosensitive drum frame for supporting said electrophotographic photosensitive drum, and
   a support frame including a first toner leakage preventing member to be positioned at one longitudinal end of said development roller and a second toner leakage preventing member to be positioned at the other longitudinal end of said development roller,
   wherein said development frame and said support frame are rotatably connected about a portion of a positioning member that positions said development roller and, in this connected state, a portion of said development frame and a portion of said support frame are welded to each other so that said development frame and said support frame are joined together; and b. feeding means for feeding said recording material.

* * * * *

UNITED STATES PATENT AND TRADEMARK OFFICE

CERTIFICATE OF CORRECTION

PATENT NO. : 5,774,766

DATED : June 30, 1998

INVENTOR(S) : TOSHIYUKI KARAKAMA ET AL.

It is certified that error appears in the above-identified patent and that said Letters Patent is hereby corrected as shown below:

COLUMN 7

Line 39, "portion" should read --portions--.

Line 42, "portion" should read --portions--.

Line 65, "12aand" should read --12a and--.

COLUMN 9

Line 1, "33a 1" should read --33a1--.

COLUMN 16

Line 12, "a mounting" should read --a. mounting--.

Line 20, "developments," should read --development,--.

Line 43, "a mounting" should read --a. mounting--.

UNITED STATES PATENT AND TRADEMARK OFFICE

CERTIFICATE OF CORRECTION

PATENT NO. : 5,774,766

DATED : June 30, 1998

INVENTOR(S) : TOSHIYUKI KARAKAMA ET AL.

It is certified that error appears in the above-identified patent and that said Letters Patent is hereby corrected as shown below:

COLUMN 18

Line 67, "where in" should read --wherein--.

Signed and Sealed this

Second Day of March, 1999

*Attest:*

*Attesting Officer*

Q. TODD DICKINSON

*Acting Commissioner of Patents and Trademarks*